United States Patent [19]

Jurgensen

[11] Patent Number: 4,689,924

[45] Date of Patent: Sep. 1, 1987

[54] EXPANDABLE STRUCTURE AND SEQUENCE OF EXPANSION

[76] Inventor: Bruce A. Jurgensen, 3412 - 17th Ave., Forest Grove, Oreg. 97116

[21] Appl. No.: 739,607

[22] Filed: May 30, 1985

[51] Int. Cl.[4] ..... E04B 1/344; E04H 1/12

[52] U.S. Cl. ..... 52/67; 52/71

[58] Field of Search ..... 52/67, 68, 69, 70, 71, 52/741, 745; 296/26, 27

[56] References Cited

U.S. PATENT DOCUMENTS

| | | | |
|---|---|---|---|
| 74,399 | 2/1868 | McMahan | 52/69 |
| 862,573 | 8/1907 | Mears | 52/69 |
| 1,438,640 | 12/1922 | Flack | 52/67 |
| 1,521,635 | 1/1925 | Lewis | 52/67 |
| 2,634,462 | 4/1953 | Graven | 52/69 |
| 2,704,223 | 3/1955 | Houdart | 296/26 |
| 2,886,856 | 5/1959 | Che | 52/69 |
| 3,137,041 | 6/1964 | Mullen | 52/67 |
| 3,195,190 | 7/1965 | Malo | 52/69 |
| 3,234,696 | 2/1966 | Spencer | 296/26 |
| 3,257,760 | 6/1966 | Calthorpe | 52/71 |
| 3,622,193 | 11/1971 | Schmidt | 52/69 |
| 4,139,229 | 2/1979 | Cooper | 296/26 |

FOREIGN PATENT DOCUMENTS

| | | | |
|---|---|---|---|
| 290795 | 3/1967 | Australia | 52/67 |
| 699753 | 3/1953 | United Kingdom | 52/68 |

*Primary Examiner*—John E. Murtagh

*Attorney, Agent, or Firm*—Norman E. Reitz

[57] ABSTRACT

An expandable structure has a core structure which may be expanded on a selected side into a composite structure incorporating the core structure and a contiguous expanded section. The selected sidewall of the core structure rotates up to become the roof of the expanded section. The sidewall, endwalls and floor section of the expanded section are hinged to the frame of the core structure and stacked vertically against the selected sidewall/roof but do not take up significant floor space within the core section. Expansion is accomplished by power beams housed within the roof and subflooring of the core structure. The sequence of expansion includes the steps of (a) rotating the selected sidewall/roof to a horizontal position as the roof of the expanded section by power beams housed within the roof of the core section; (b) driving the sidewall of the expanded section outwardly by power beams housed within the subflooring of the core structure; (c) driving the endwalls outwardly; and (d) rotating the floor of the expanded section downwardly to form an extension of the floor of the core section.

15 Claims, 49 Drawing Figures

8
32
40'
40
43
37
14
26
46
45
47

FIG. 32.
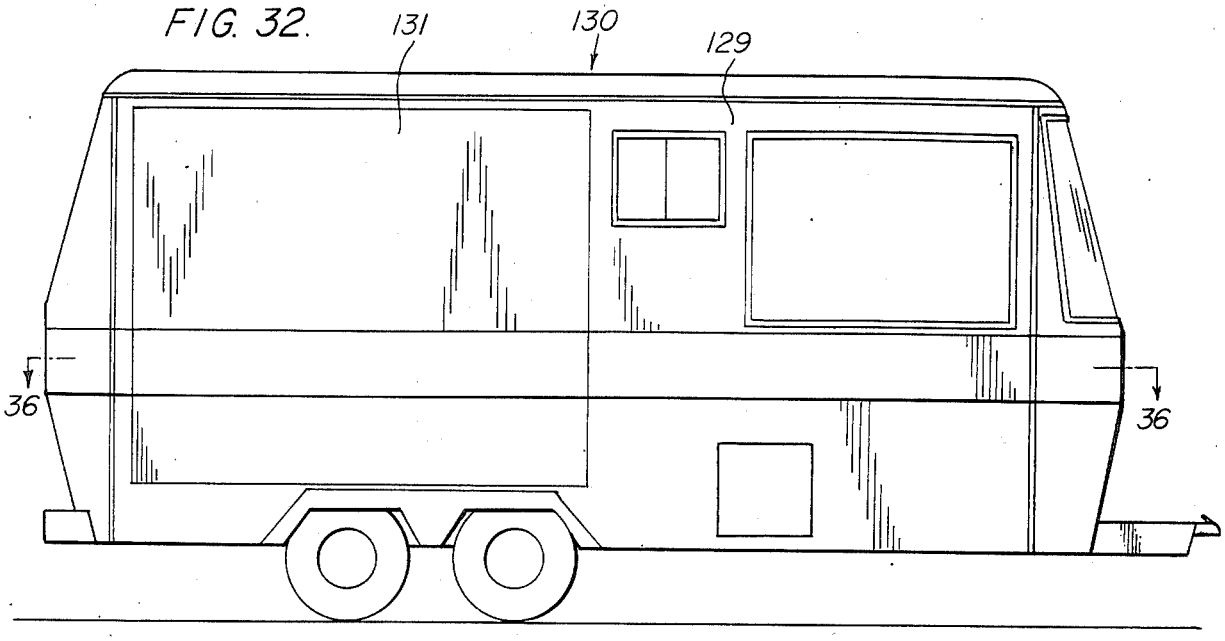
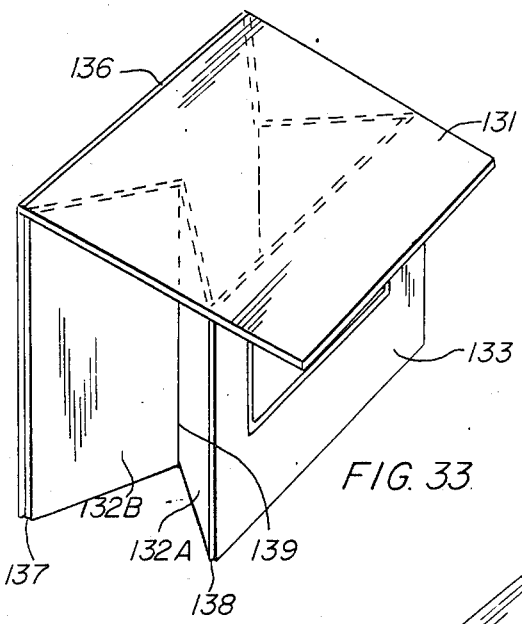
FIG. 33.
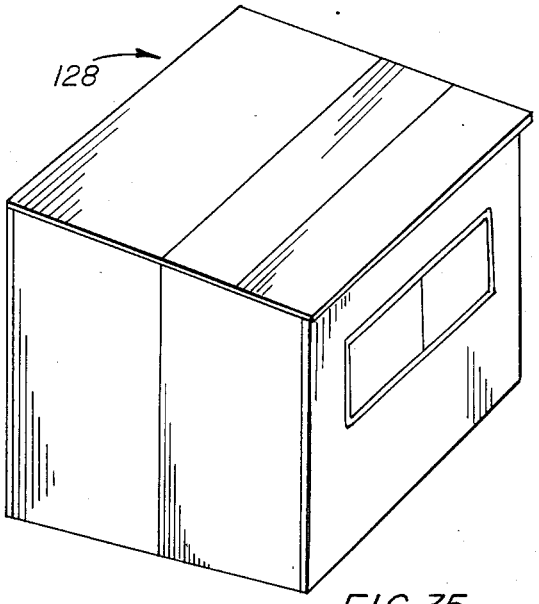
FIG. 35.
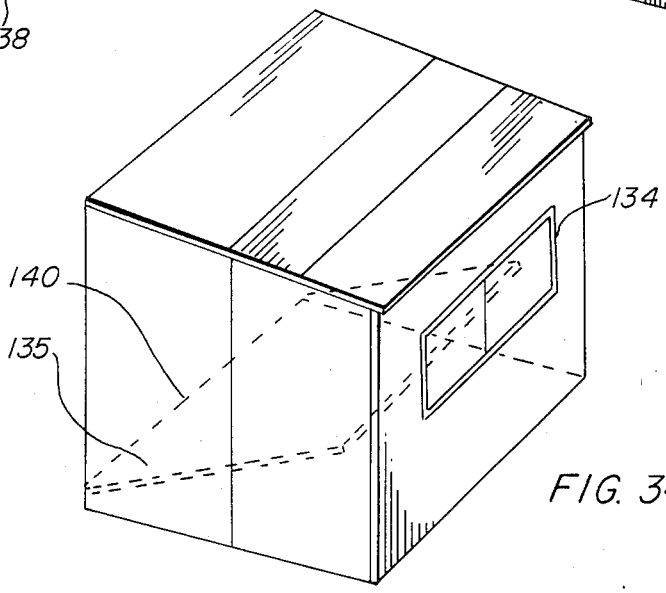
FIG. 34.

EXPANDABLE STRUCTURE AND SEQUENCE OF EXPANSION

This invention relates to an expandable structure and, more particularly, relates to a structure which may be expanded to provide a multiple of its original floor space, with minimal effort and in minimum time.

Numerous applications exist for structures which may be expanded upon demand. For example, in case of natural disaster, war, field events, advertising or promotional displays, it may be desired to transport an expandable structure to a site and open it up to provide its expanded floor space for as long as required. The structure can then be collapsed and returned to storage or moved to another site. Prior structures of this type have either been of insubstantial construction so as to not accommodate heavy duty equipment or the performance of sophisticated procedures or have required long periods to assemble. For example, in J. A. Wenger, et al., "Mobile Center," U.S. Pat. No. 3,620,564, lightweight structures are provided for expansion from a mobile center for use as a portable stage for the performing arts. Lightweight sidewalls and endwalls are provided in one version for manual deployment to make up an enclosed structure. Transient and auxiliary applications are contemplated rather than heavy duty usage. In addition, in J. L. Geihl, "A Foldable and Expandable Modular Shelter Unit," U.S. Pat. No. 3,827,198, a small modular shelter is proposed which is to be combined with other modules to form a functional field unit. These modules must be brought one-by-one to a site, arranged properly and then deployed before the composite unit is available for use. And in A. J. Reynolds, "Expandable Portable Shelter," U.S. Pat. No. 3,421,268, a small expanded section may be unfolded from an externally attached array of panels. The expanded section is neither self-supporting nor susceptible to heavy duty usage.

Alternately, it may be desired to expand the interior volume of a stationary structure at particular times. For example, it may be desired to add a sun porch during the summer, an extra room to a mobile home or the like. Prior structures of this type have typically required the expanded portion of the structure to be housed in their assembled configuration within the interior volume of the core structure. Thus, tipouts in mobile homes are typically slid outwardly from within the interior volume of the core structure and are thus limited in size to the dimensions of the mobile home. Consequently, the floor space added by the tipout is, at most, equal to the floor space of the mobile home and is available only on one side. See, for example, the expandable structure disclosed in C. A. West, "Expandable Building With Telescoping Enclosures and Hingedly Connected Barriers," U.S. Pat. No. 3,653,165, and in particular FIGS. 10 and 11. On the other hand, if tipouts are fabricated so as to extend from both sides of a structure, the floor space of each tipout is at most one-half the floor space of the structure.

A principal objective in the provision of a practicable expandable structure is that the equipment and supplies required for the application be stored within the core structure. Thus, if a structure is to be used as a field hospital, it is highly desirable that medical equipment and supplies fit within the volume of the core structure so that a turnkey hospital can be transported and put into operation on demand. Also, it would not be desirable to have the hardware used for the expansion of the structure reside within the interior volume. In the collapsed mode, the hardware would diminish the effective storage volume; in the expanded mode, the hardware would visually or physically interfere with the accomplishment of the application. Thus, it would be desirable to provide an expandable structure in which a minimal storage volume is required for the structural members which make up the expanded portions of the structure and which have no expansion hardware in the interior volume. It would further be desirable to have a streamlined design for the core structure which does not include structural members attached to the exterior of the core structure.

SUMMARY OF THE INVENTION

An expandable structure is provided which may be expanded on any selected side to a width at least equal to the width of the core structure. The sidewall, endwalls, and floor section of the expanded section are stored as vertical members in close packed relationship adjacent the selected sidewall of the core structure. A substantial portion of the selected sidewall serves as the roof of the expanded section.

Expansion of the structure is preferably accomplished by power beam units mounted in the roof of the core structure and within the subflooring of the core structure or may be acomplished manually in small scale embodiments. The power beam units derive the various structural members of the expanded section outward in succession. The power beam units may be hydraulically, mechanically or manually actuated. When deployed in the expanded mode, each set of structural members forms an expanded section contiguous to the core section with a floor space comparable to that of the core section.

The preferred sequence of expansion is as follows:

(a) The substantial portion of the selected sidewall of the structure is rotated about a hinge from its vertical position to a generally horizontal position where it serves as the roof of the expanded section (hereinafter the "selected sidewall/roof");

(b) The sidewall of the expanded section is driven outward to a position parallel to the unexpanded position of the selected sidewall/roof and to a distance therefrom comparable to that of the width of the core structure;

(c) The endwalls are pulled out as a part of step (b) if they are hinged to the sidewall of the expanded section or may now be deployed in this step separately if they are hinged to the frame of the core structure; and (d) The floor is rotated down about a hinged connection with the floor of the core structure to a position which is an extension of the floor of the core section.

BRIEF DESCRIPTION OF THE DRAWINGS

For a more complete understanding of the expandable structure and the sequence of expansion of the present invention, reference may be had to the accompanying drawings which are incorporated herein by reference and in which:

FIG. 32 is a side view of a travel trailer which incorporates a manually operable expandable structure in accordance with the present invention;

FIG. 33 is a perspective view of the expanded section from FIG. 32 after the selected sidewall has been raised to form the roofs and the sidewall of the expanded section and the endwalls have been partially deployed;

FIG. 34 is a further view of FIG. 33 after the sidewall and endwalls have been fully deployed and the floor is partially rotated into position;

FIG. 35 is a further view of FIG. 34 after the expanded section has been fully deployed;

DESCRIPTION OF THE PREFERRED EMBODIMENTS

Expandable structures may be utilized either as mobile units or in fixed locations. Mobile expandable structures would be moved by air, sea or ground transportation on demand to a location where a particular application is to be performed. Examples of these applications include field hospitals, famine relief centers, vaccination clinics, military headquarters, promotional displays and portable instructional facilities. It would further be desirable if such structures could contain turnkey operating units. For these objectives to be achieved, it is necessary that the expansion feature of the units not interfere with the storage of operating equipment within the unit. Also, it would be most useful if expansion of the units could be carried out in a short time by unskilled personnel. The fixed location mode of use of expansible structures would allow the seasonal setup of a structure of significant size, the use of the structure at will, or protection of the structure against vandalism since the structure could be collapsed to its core while not in use. Examples of stationary uses would include mobile homes, residences with expandable patios, homes with rooms which can be collapsed when the owner is not present, and concessions which are operated intermittently. It is the aim of the present invention to address these applications.

Expandable Structure

Figure 1:
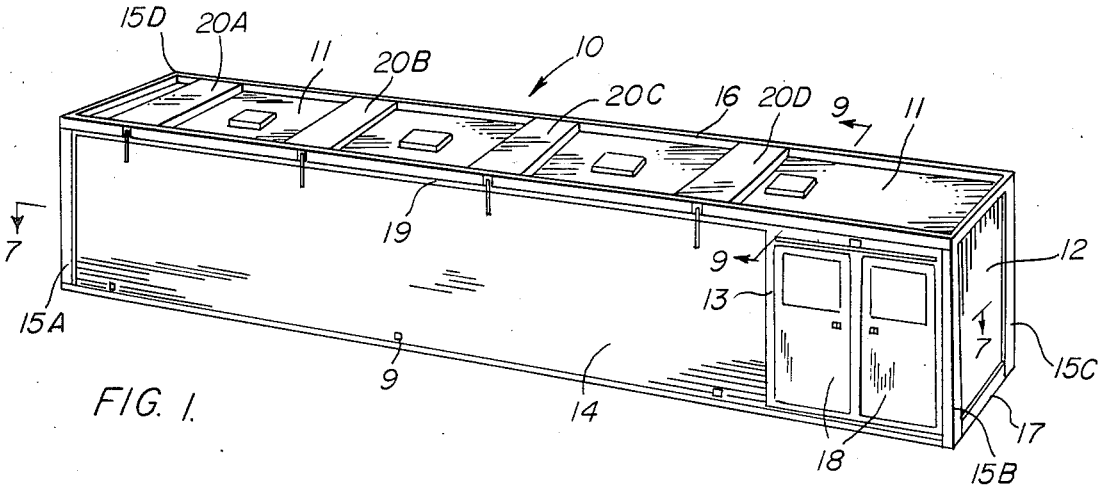
FIG. 1 is a perspective view of the expandable structure in the unexpanded mode.

In accordance with the present invention, a core structure 10 is provided as shown in FIG. 1. The core structure 10 has a conventional metal or wood frame which consists of vertical corner members 15A, 15B, 15C, and 15D; roof perimeter frame 16 and floor perimeter frame 17. The core structure has endwalls 12, sidewalls 13, and a roof consisting of sections 11 interspersed between power beam enclosures 20A, 20B, 20C, and 20D. A substantial portion 14 of a sidewall 13 selected for expansion is hinged by continuous hinge 19 to the roof perimeter frame 16. This substantial portion 14 will be designated as the "selected sidewall/roof" 14 throughout this specification. The particular core structure 10 shown in FIG. 1 is sized for transport on a trailer, for placement in a military cargo plane, on board ship or on a detachable set of wheels to be pulled by a highway tractor. As seen in the top cross sectional view of FIG. 7 and in the end cross sectional view of FIG. 9, the central area 43 of the overall floor space, and thus the bulk of the interior volume, is available for storage in the unexpanded mode. This feature of the present invention exists because the structural members are stacked adjacent each other and against the selected sidewall/roof 14, i.e. against the sidewall which will in due course be rotated outwardly to become the roof of the contiguous expanded section. In the preferred embodiment, the sole means of connecting the structural members of the expanded section to the core structure are continuous hinges which form unobtrusive, connections about which the structural members may be rotated from their stacked, stored positions to their deployed positions. The means used to accomplish expansion, as described in brief subsequently herein and in detail the co-pending applications of Bruce A. Jurgensen, all filed on May 30, 1985, and entitled, "Power Beam For Rotating Structural Member" (Ser. No. 739,555), "Power Beam For Moving Structural member" (Ser. No. 739,554) and "Power Beam For Moving Structural Member" (Ser. No. 739,549), are housed unobtrusively within the roof structure and within the subflooring. They are designated as power beams and serve to transfer linear or rotational forces to the structural members, as needed for deployment or contraction of the expanded sections. Thus, medical equipment, food, and even personnel may be occupy the interior volume of the core structure 10 while the structure is stored, is being transported or before the expanded sections are deployed. Access to the interior volume of the embodiment of FIGS. 1–6 is gained through doors 42, shown in FIG. 7, to be located on the rear end of the core structure 10. In an alternate embodiment of the expandable structure, shown in FIG. 10, access to the interior volume is gained through the double doors 42 located on the front end of the core structure. Thus, due to the large amount of floor space not occupied by the structural members, the core structure 10 is useful even in the unexpanded mode.

Figure 9:
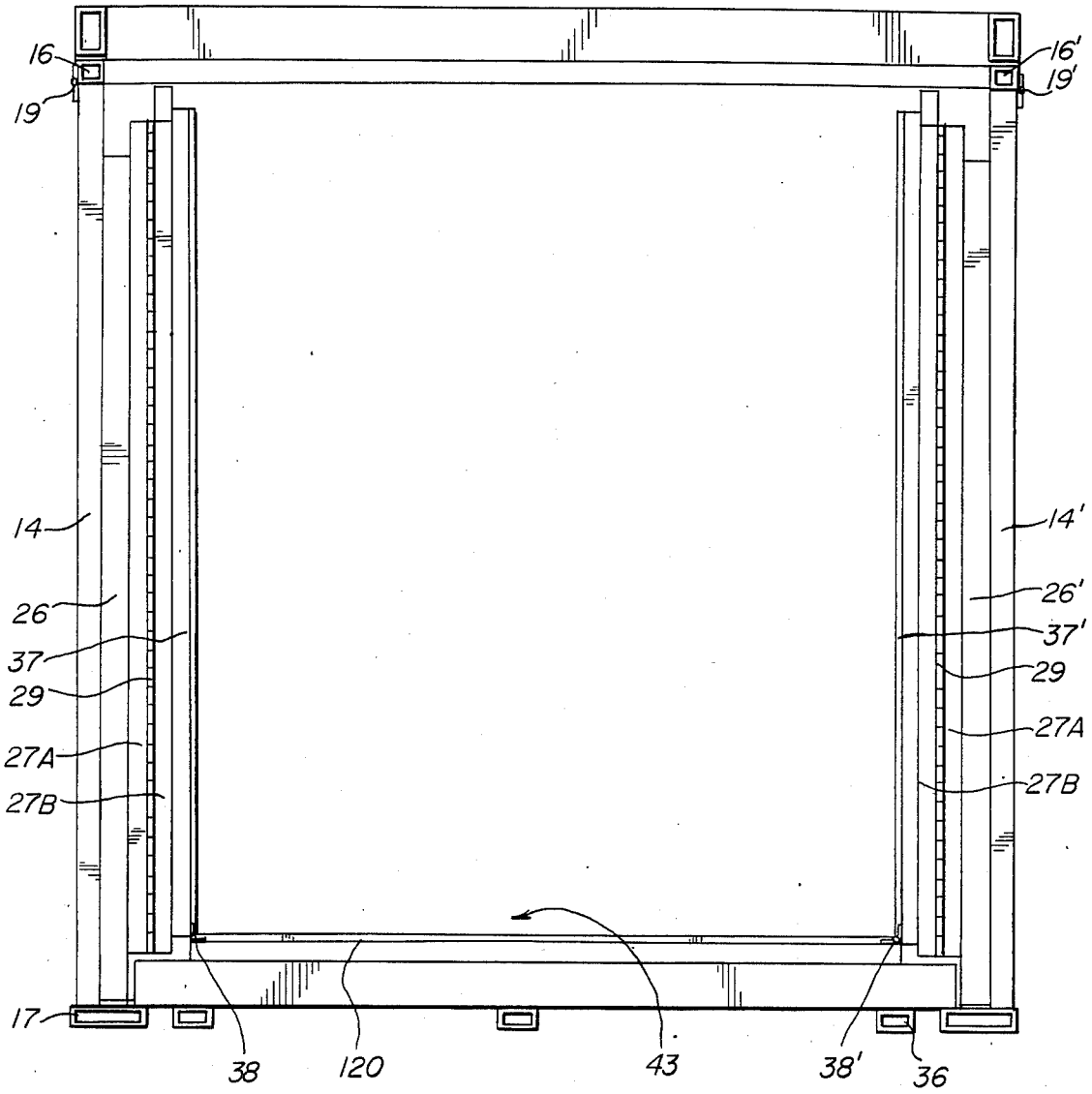
FIG. 9 is a cross sectional end view taken through lines 9—9 of FIG. 1 further illustrating the structural members of an expanded section and their order of stacking.
Figure 12:
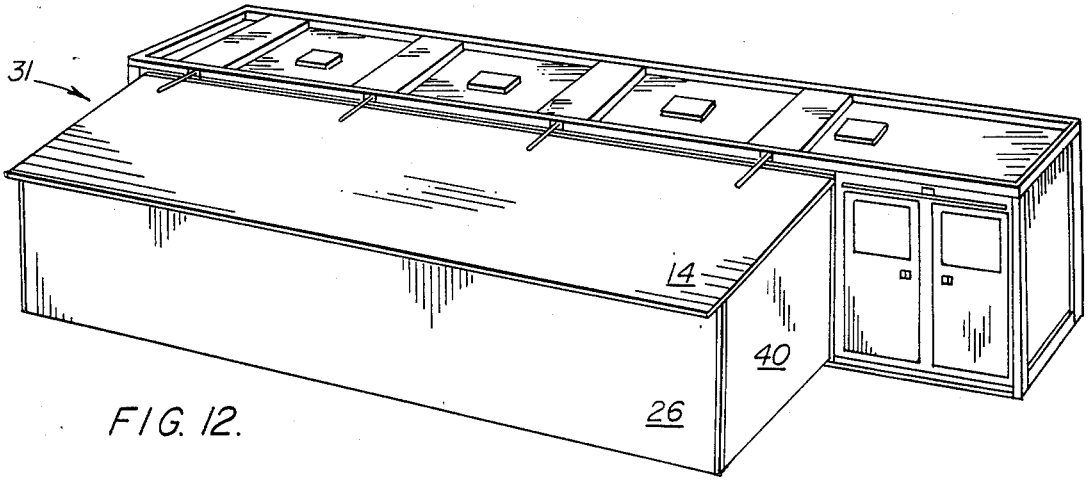
FIG. 12 is a further view of FIG. 11 after the expanded section is fully deployed.
Figures 13, 13A, 14, 15A, 15B:
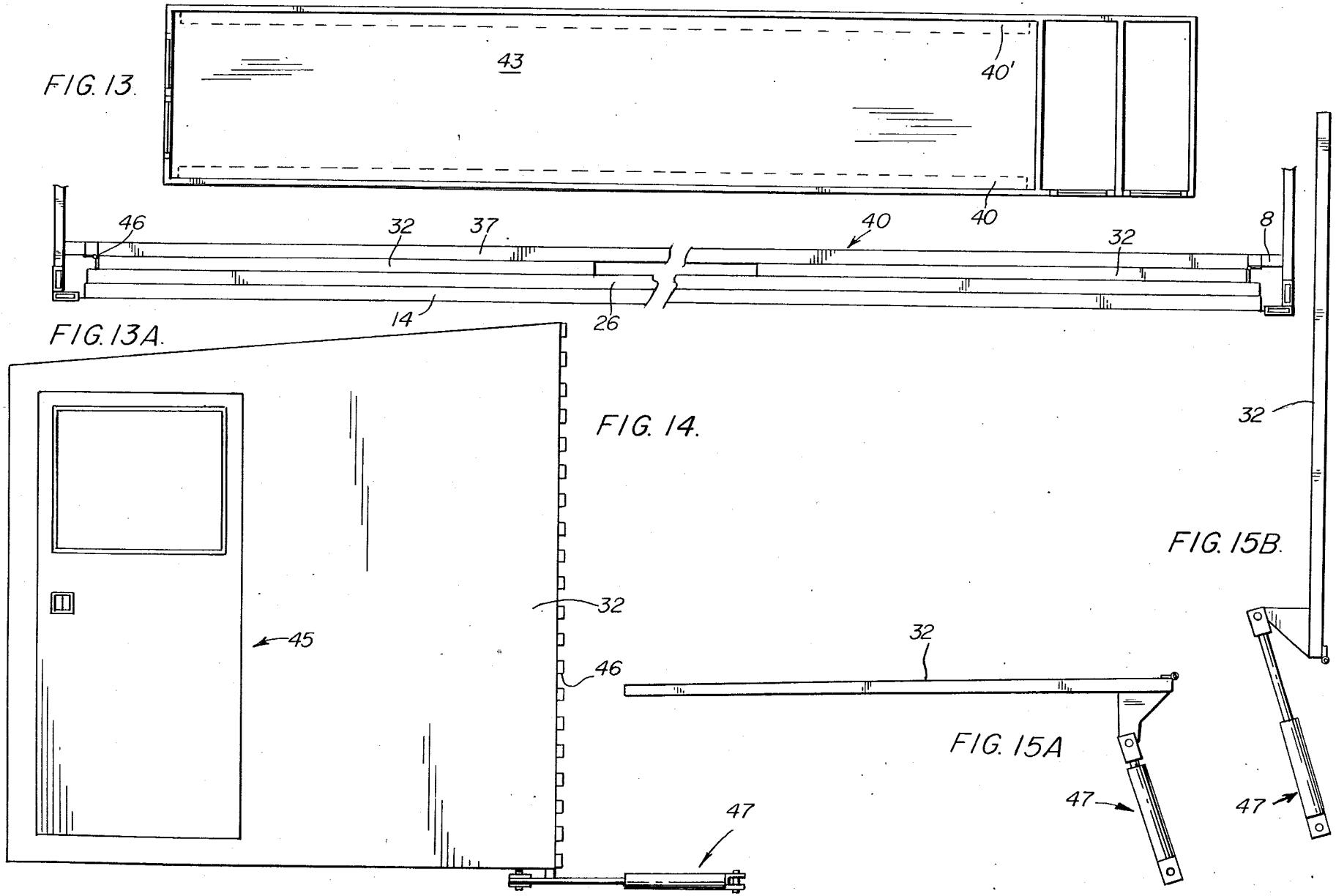
FIG. 13 is a cross sectional view through a unit of the type of FIG. 11 which shows the structural members as stacked adjacent the selected sidwall/roof.
FIG. 13A is an enlarged view of one of the sets of structural members, showing the order of stacking for this embodiment.
FIG. 14 is a side view of a solid endwall and hydraulic actuating unit of the embodiment of FIGS. 11–13A.
FIG. 15A is a plan view of FIG. 14 after the endwall has been rotated to a closed position.
FIG. 15B is a plan view of FIG. 14.
Figure 16:
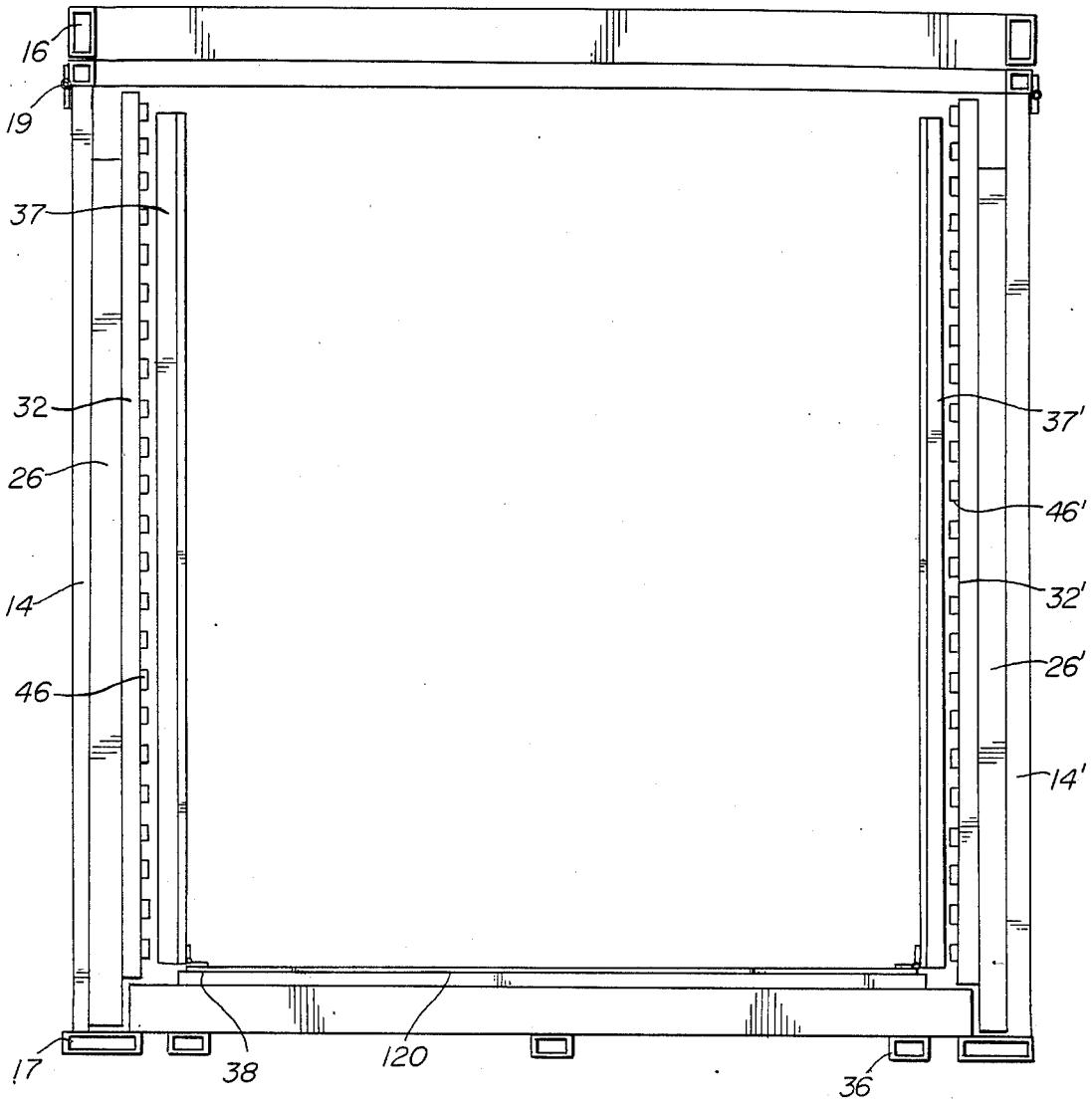
FIG. 16 is an end cross sectional view of the embodiment of FIGS. 11–13A showing the stored structural members and their order of stacking.
Figure 17:
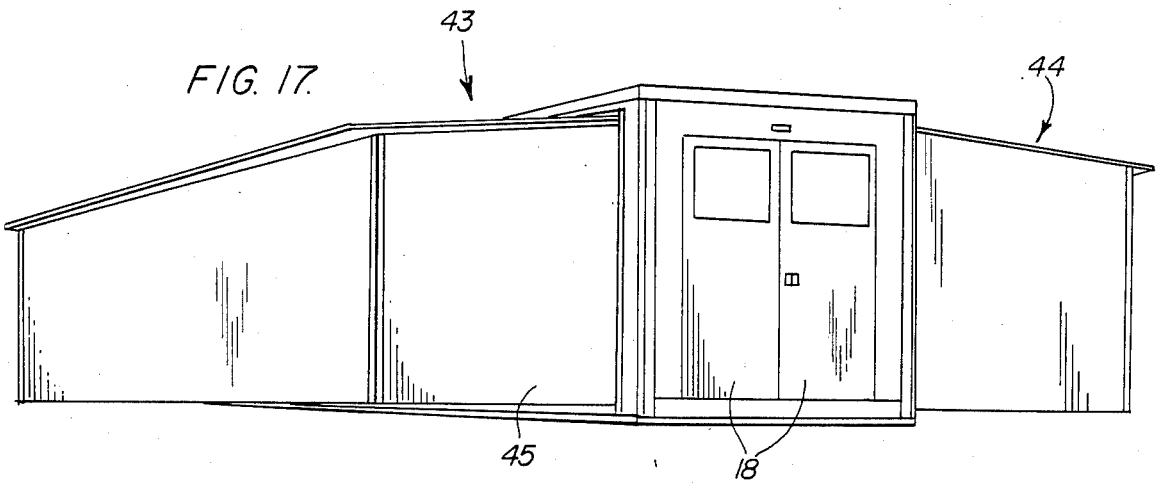
FIG. 17 is an end perspective view of an embodiment of the expanded structure which has single unit endwalls, a pair of expanded sections and a door at the end of the core structure.

The structural members of the expanded section are stacked adjacent each other in a specific order so as to be available for expansion in sequence (see Sequence of Expansion subsequently). The order of stacking for the small scale, manual version is shown in the cross sectional view of FIG. 36. Here, the selected sidewall/roof 131 serves as a principal portion of the sidewall of the recreational vehicle structure 130 but is available for rotation upwards to form the roof of the expanded section. Adjacent selected or sidewall or window wall-/roof 131 is the sidewall 133 of the section to be formed by expansion. Then, adjacent sidewall 133 are the endwalls 132A and 132B which are attached to sidewall 129 by a continuous hinge 137. Finally, the floor 135 is stacked awaiting rotation to a horizontal position. For the larger units having power beam actuation, the order of stacking is the same. Thus, for the embodiment of FIGS. 1–6, the order of stacking is shown in FIGS. 7A and 9 as selected or window wall sidewall/roof 14, sidewall 26, endwalls 27A and 27B, and floor 37. For the embodiment of FIGS. 11–12 having a unitary endwall, the order of stacking is shown in FIG. 13A to be selected sidewall/roof 14, sidewall 26, endwall 32 and floor 37. In all of these versions there need be no appreciable space between the structural members in their stacked positions since the connecting hinges are along the edges and since the actuation is by power beams which are enclosed within the roof or subflooring of the core structure or is carried out manually.

Figure 18:
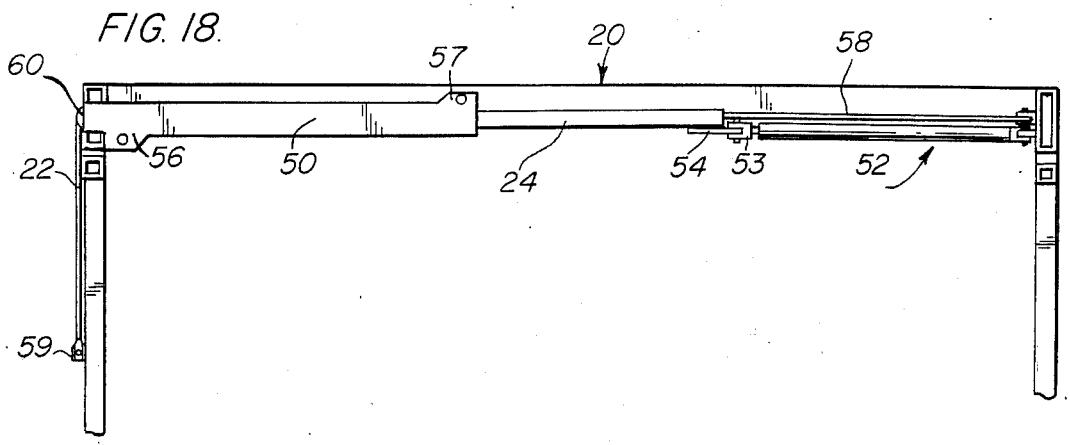
FIG. 18 is a side view of one embodiment of the upper power beam in its retracted position.
Figure 19:
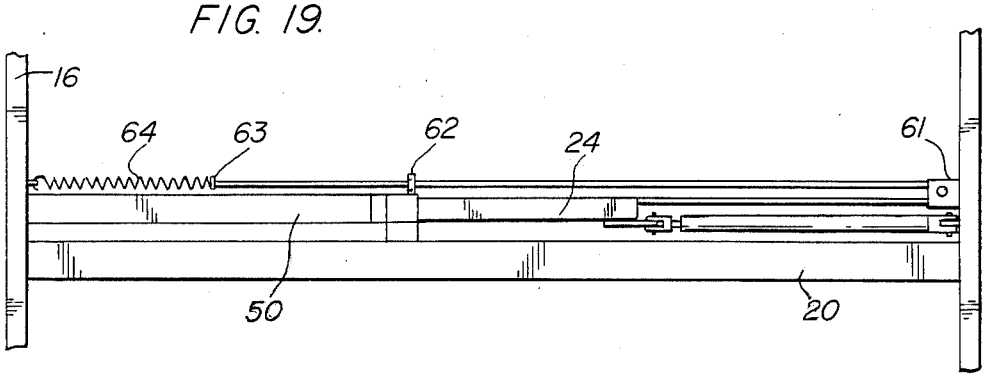
FIG. 19 is a plan view of the upper power beam of FIG. 18 in its retracted position.
Figure 20:
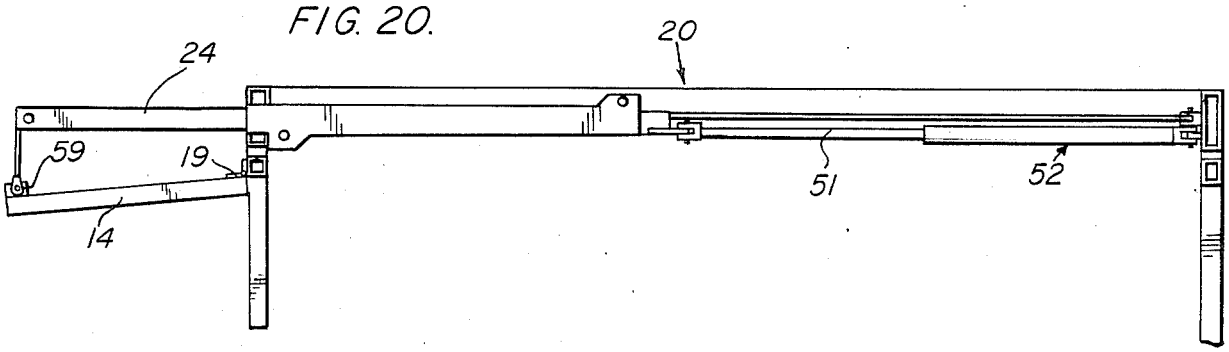
FIG. 20 is a side view of the upper power beam of FIG. 18 in its fully extended position illustrating the outward rotation of the selected sidewall to become the roof of expanded section.
Figure 21:
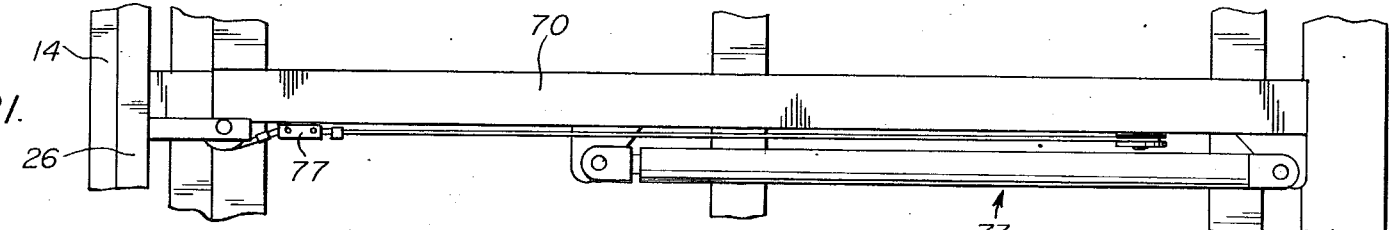
FIG. 21 is a plan view of one embodiment of the lower power beam in its fully retracted position.
Figure 22:
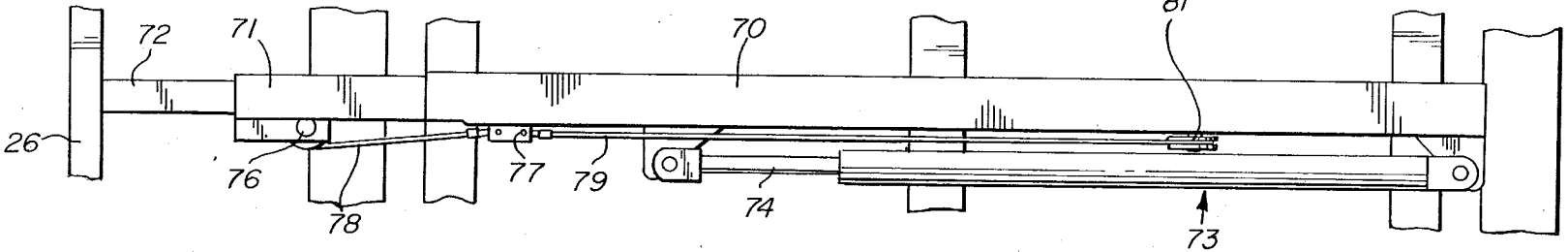
FIG. 22 is a view of FIG. 21 after the lower power beam has been partially extended.

For expandable structures with power beam actuation, as shown in FIGS. 1–6 and 11–12, there is provided within the roof of the core structure upper power beam units 21A, 21B, 21C and 21D, for rotating the selected sidewall/roof 14 upwardly to form the roof of the expanded section. One of these upper power beams is shown in FIGS. 18–20. The torque for producing rotation is applied by cable 58 which extends from its attachment to spring 63, around pulley 61, through slideable beam 24 and out to an exposed portion 22 which is attached by swivel connection 59 to selected sidewall/roof 14. The selected sidewall/roof 14 is raised from the sidewall (vertical) mode to the roof (horizontal) mode as hydraulic cylinder 52 drives slideable beam 24 outwardly. For a detailed description see the co-pending patent application of Bruce A. Jurgensen, "Power Beam for Rotating Structural Member," Ser. No. 739,555, filed on May 30, 1985.

A linear power beam for driving the sidewall or window wall out is housed in the subflooring of the core structure and is shown in FIGS. 21–23A. This linear power beam comprises a hydraulic cylinder which actuates a series of telescoping members that are interconnected by pulleys and a pair of cables. This linear power beam is described in detail in the co-pending application of Bruce A. Jurgensen entitled "Power Beam for Moving Structural Member," Ser. No. 739,554, filed on May 30, 1985. Briefly, as shown in the sequence of FIGS.

Figure 23:
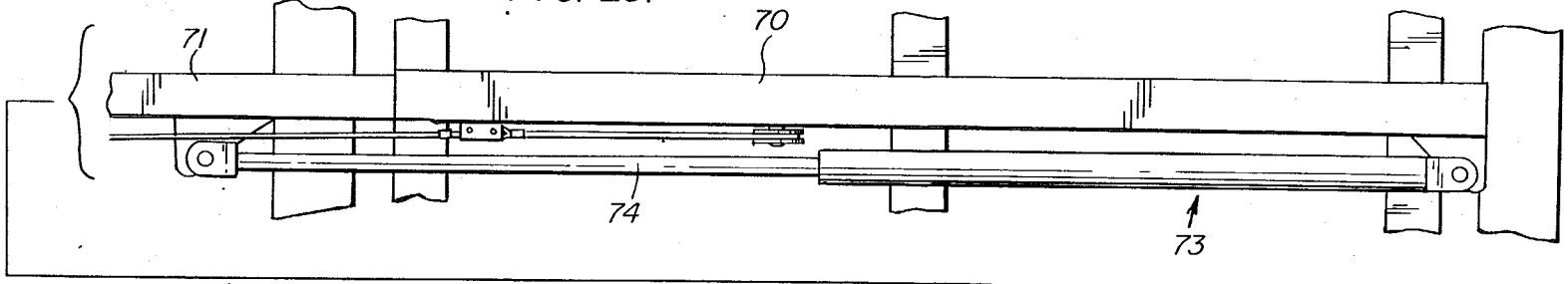
FIGS. 23 and 23A together are a plan view of the lower power beam its fully extended position.
Figure 23A:
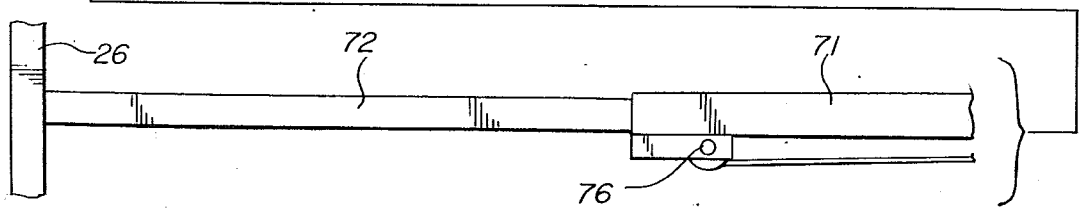
Figure 24:
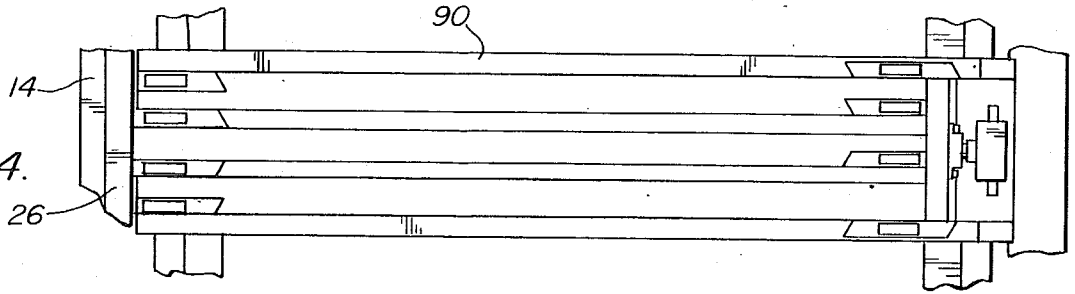
FIG. 24 is a plan view of a screw drive embodiment of the lower power beam in its fully retracted position.
Figure 25:
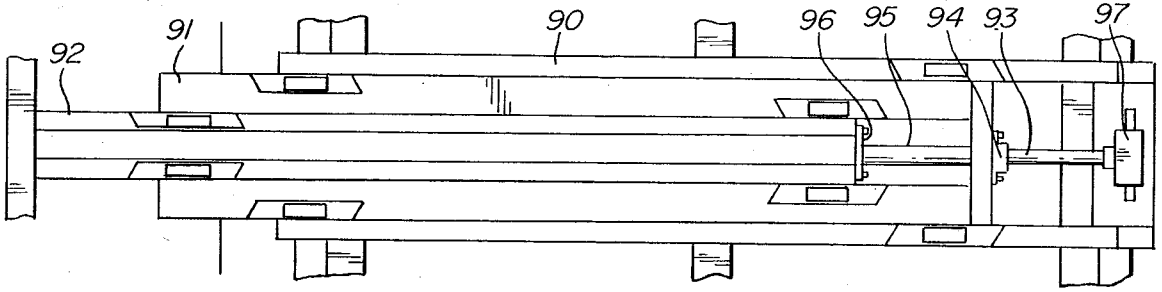
FIG. 25 is a view of FIG. 24 after the lower power beam has been partially extended.
Figure 26:
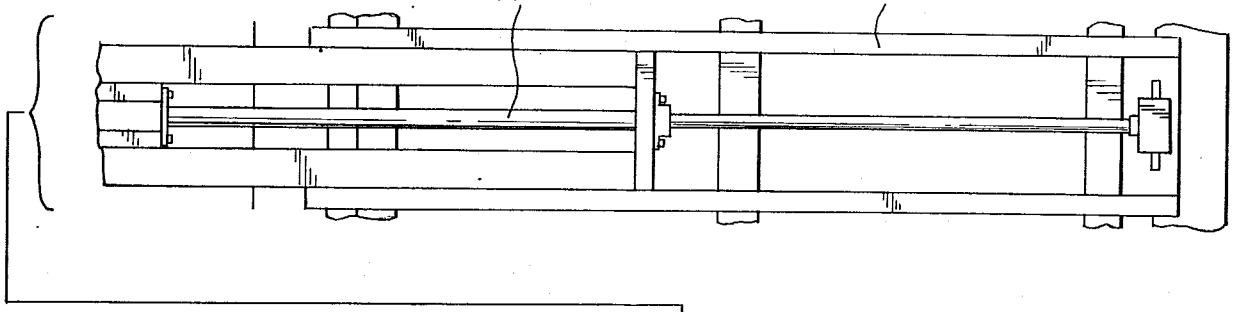
FIGS. 26 and 26A together illustrate the embodiment of FIGS. 24–25 after it has been fully extended.
Figure 26A:
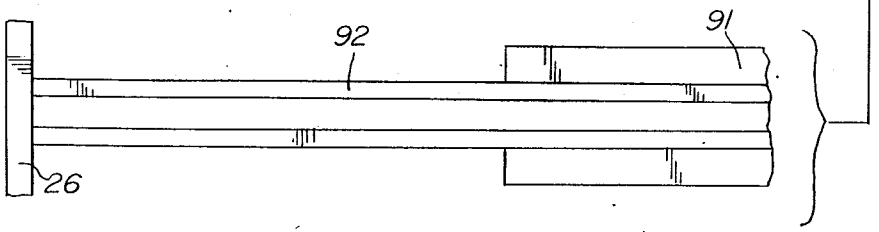
Figure 27:
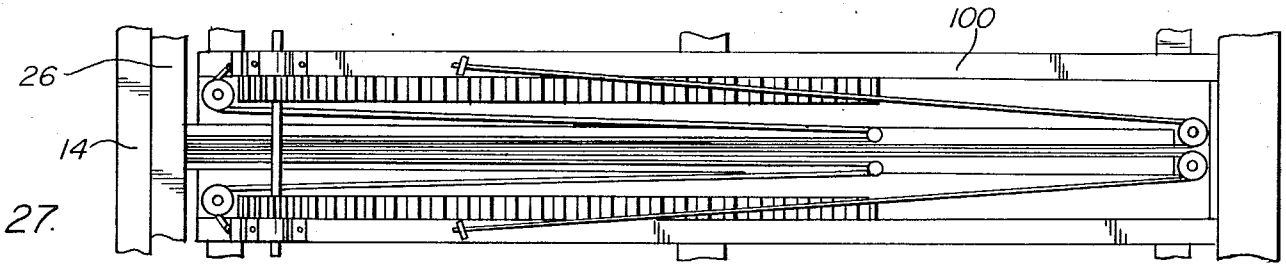
FIG. 27 is a plan view of a rack and pinion embodiment of the lower power beam in its fully retracted position.
Figure 28:
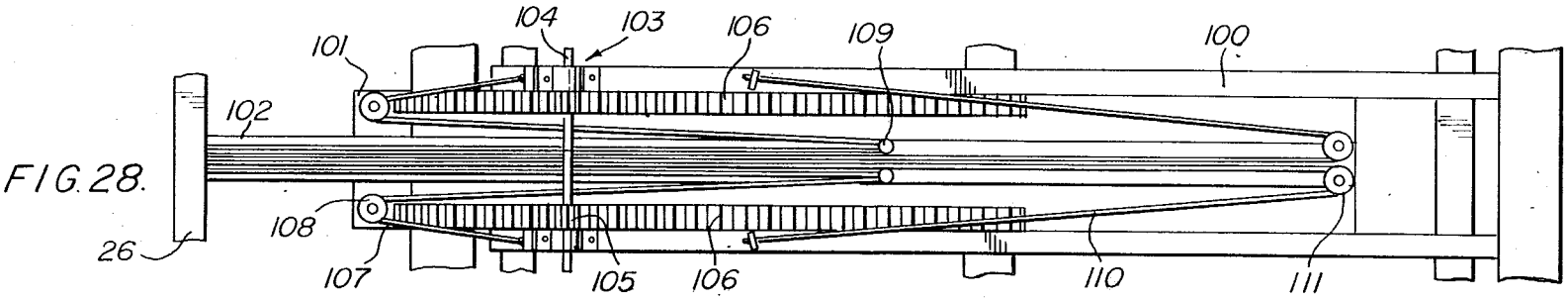
FIG. 28 is a plan view of FIG. 27 after the power beam has been partially extended.
Figure 29:
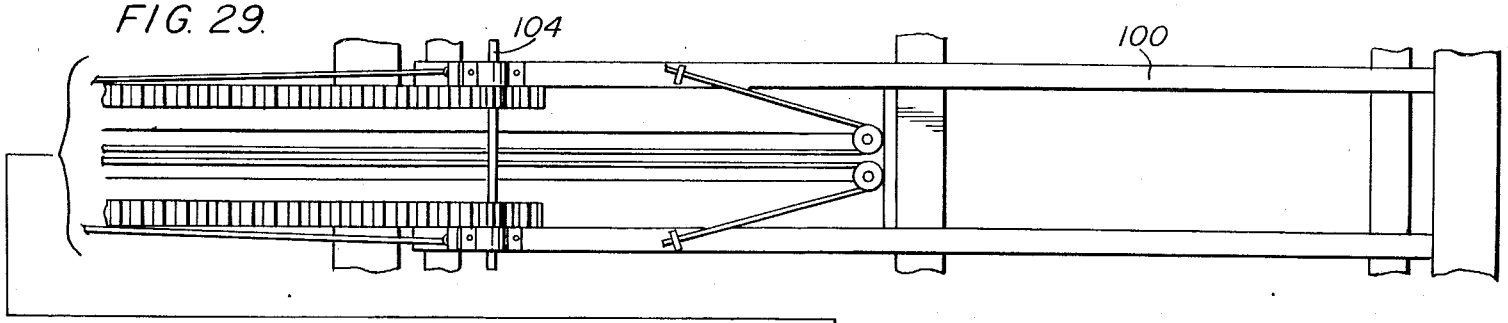
FIGS. 29 and 29A together illustrate the power beam of FIGS. 27–28 after it has been fully extended.
Figure 29A:
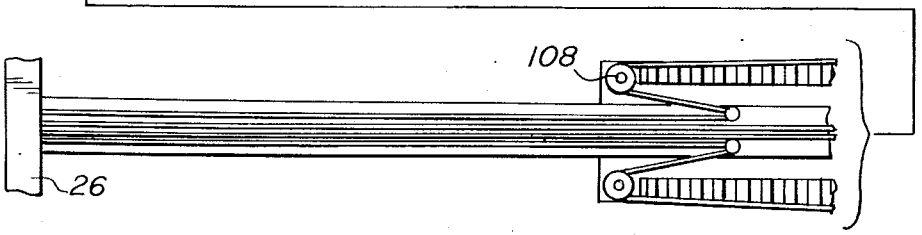

21-23A, the sidewall 26 is driven outwardly once the selected sidewall/roof 14 has been rotated out of the way. The cylinder rod 74 of hydraulic cylinder 73 drives the intermediate telescoping member 71 outwardly from within stationary member 70 and at the same time the forward member 72 is propelled outwardly from within telescoping member 71. The outward cable 78 serves to apply the outward force until the point of full deployment depicted in FIG. 23A is reached while the inward cable 79 retracts the wall 26 as the cylinder rod 74 is retracted. Preferably, hydraulic cylinder 73 is double acting to permit the wall to be positively held in all positions. Alternate linear power beam units are depicted in the sequences of FIGS. 24-26A and FIGS. 27-29A. In each sequence the topmost view shows the linear power beam fully retracted, the second view shows the power beam partially extended and the last two views together showing the power beam to be fully extended. The power beam of FIGS. 27-29A is also described and claimed in the co-pending application of Bruce A. Jurgensen, Ser. No. 739,554, described above. Here, the drive for the intermediate telescoping member 101 is provided by the pinion assemblies 103 which apply a linear force to the racks 106 which are attached to the intermediate telescoping member 101. The outward actuating cable 107 provides an outward force to the forward telescoping member 102 by means of the thrust cylinders 109. The inward actuating cable 110 draws the wall 26 inwardly as the shaft 104 of the rack and pinion assembly reverses direction and drives the intermediate telescoping section 101 inwardly.

The linear power beam for driving the sidewall out and drawing it in shown in FIGS. 24-26A employs a series connected, manually driven Acme screw drive and is described in detail in the co-pending application of Bruce A. Jurgensen, "Power Beam for Moving Structural Member," Ser. No. 739,549, filed on May 30, 1985. Briefly, a threaded shaft 93 is mounted axially within stationary member 90. Threaded shaft 93 is seated in gear box 97 and journals through a first threaded actuation nut 94 attached to the end of intermediate telescoping member 91. As the threaded shaft 93 rotates, a linear force is imparted to intermediate telescoping member 91 through threaded nut 94. The threaded shaft 93 mates with a threaded tube 95 which is mounted axially within intermediate telescoping member 91. The threaded tube 95 journals through a second threaded actuation nut 96 attached to the end of forward telescoping member 92. Thus, as threaded shaft 93 rotates, the threaded tube 95 rotates in concert and a linear force is imparted to forward telescoping section 92 through second threaded actuation nut 96. A twofold linear motion is thus applied to the sidewall 26 being deployed or retracted. For a detailed description of the structure and mechanical action of this power beam see the aforementioned co-pending patent application.

Figure 2:
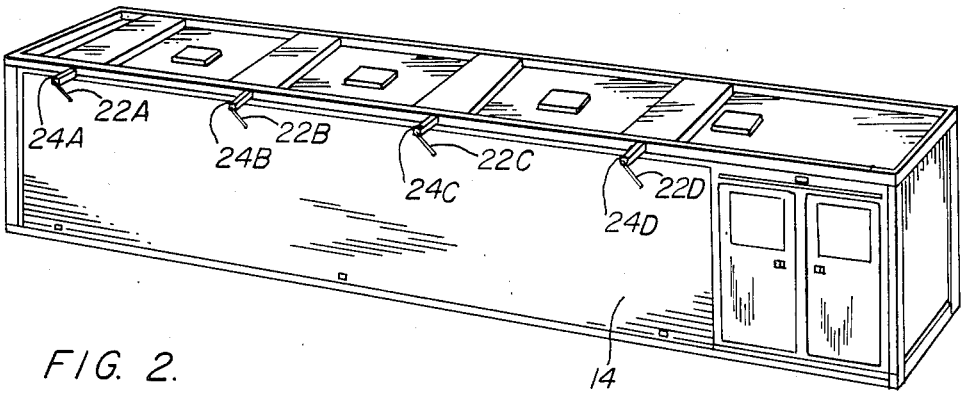
FIG. 2 is a view of FIG. 1 after the upper power beams have been extended to the position where a force begins to be imparted to the selected sidewall/roof to rotate it upwardly.
Figure 3:
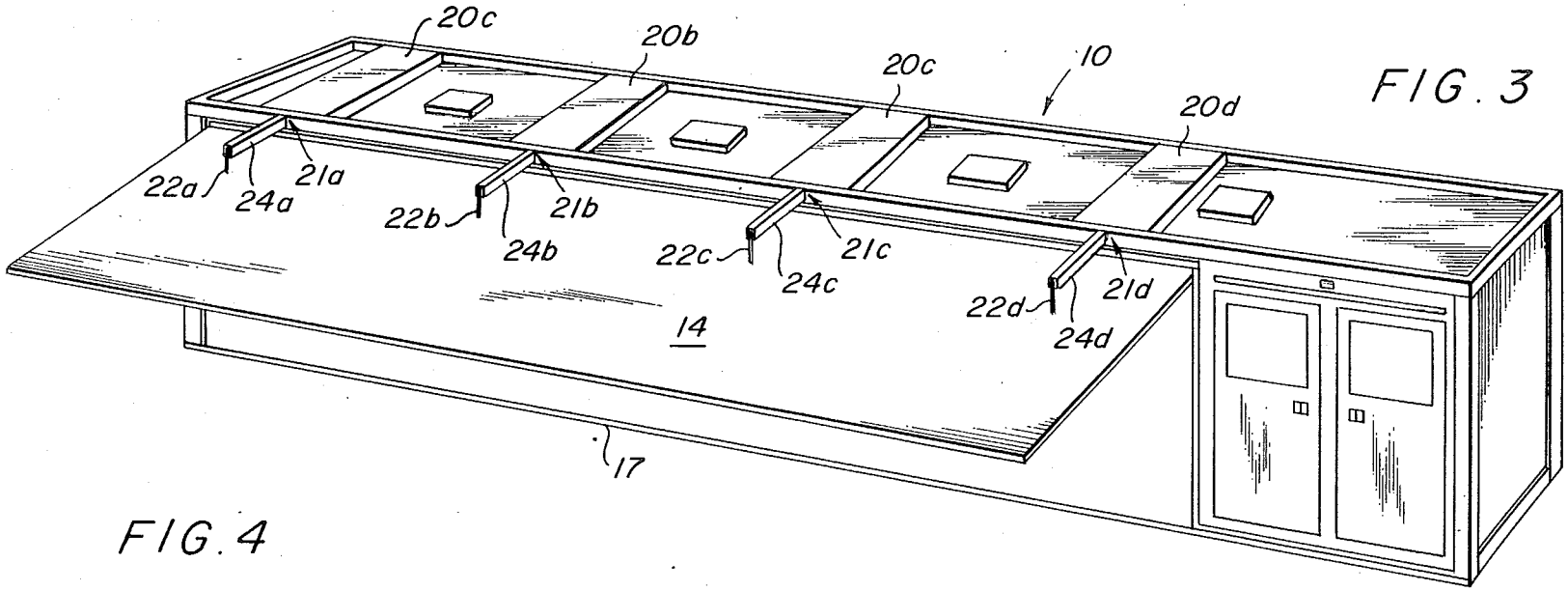
FIG. 3 is a view of FIG. 1 after the upper power beams have been extended sufficiently to raise the selected sidewall/roof to a near-horizontal position where it serves as the roof of the expanded section.
Figure 4:
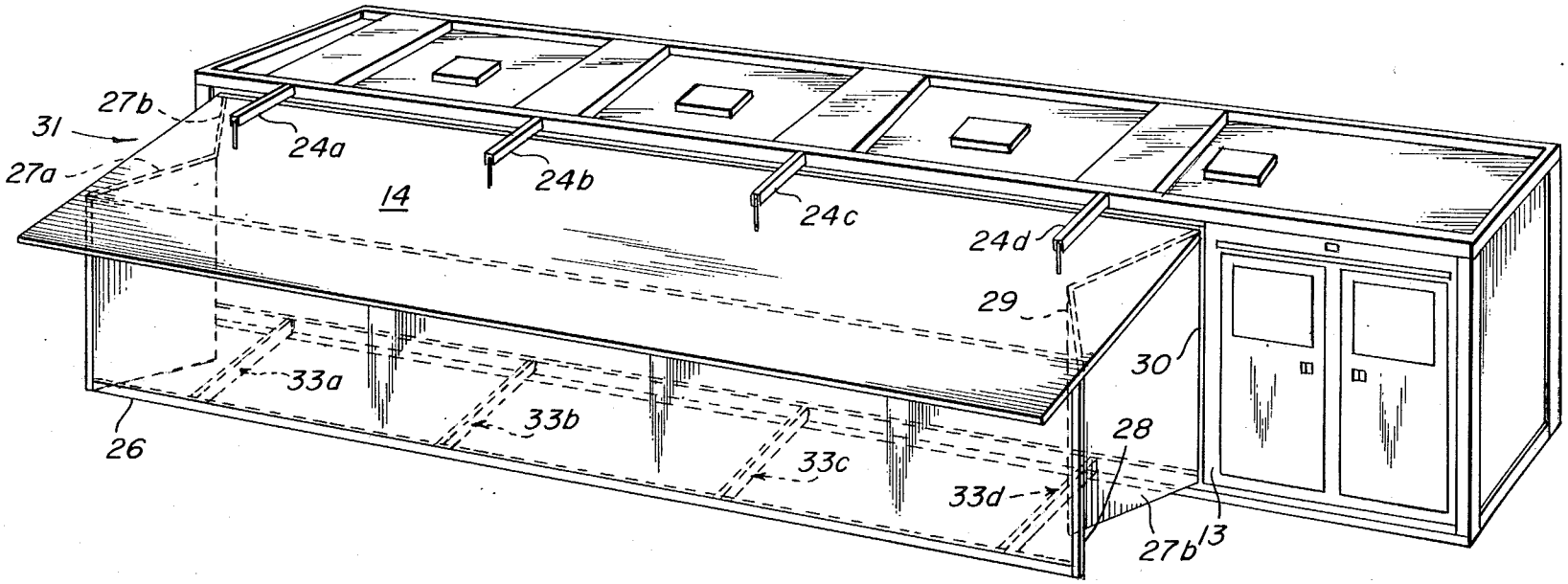
FIG. 4 is a view of the expandable structure after the lower power beams have driven the sidewall of the expanded section outwardly to an intermediate position underneath the selected sidewall/roof and pulled along the attached endwalls.
Figure 11:
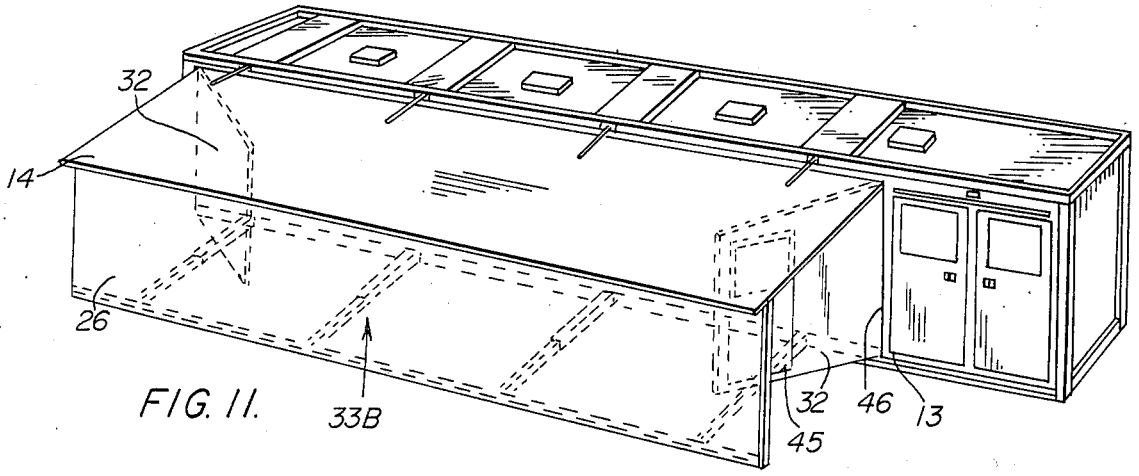
FIG. 11 is a perspective view of an alternate embodiment of the expandable structure in which the endwalls are a single unit and rotate into position after the sidewall is deployed.

As shown particularly in FIG. 4, in the embodiment of FIGS. 1-6, the outward endwall section 27A is connected with sidewall 26 by means of continuous hinge 28 and with inward endwall section 27B by continuous hinge 29. Inward endwall section 27B is further connected with the sidewall 13 by continuous hinge 30. Both sets of endwall sections are connected in the same manner. Thus, when sidewall 26 is fully deployed, the two sections of each endwall 27 are deployed on either side of the now completed enclosure 31. In the embodiment of FIGS. 11-12, the endwall 32 is a single unit and is hinged only on one side to the sidewall 13.

Figure 30:
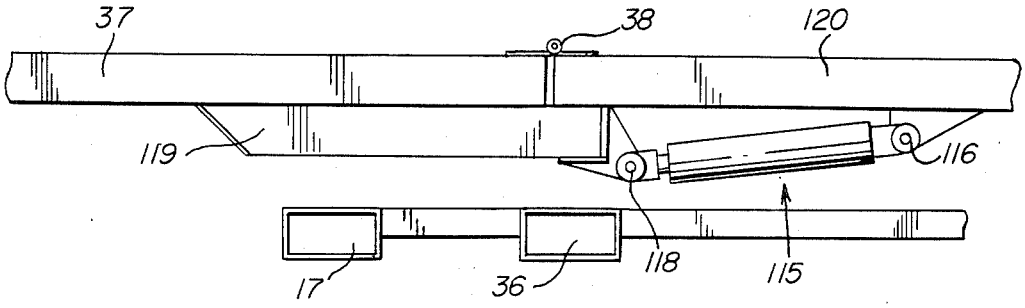
FIG. 30 is a side view of a mechanism for rotating the floor of the expanded section between the vertical, stored position and the horizontal, expanded position.
Figure 31:
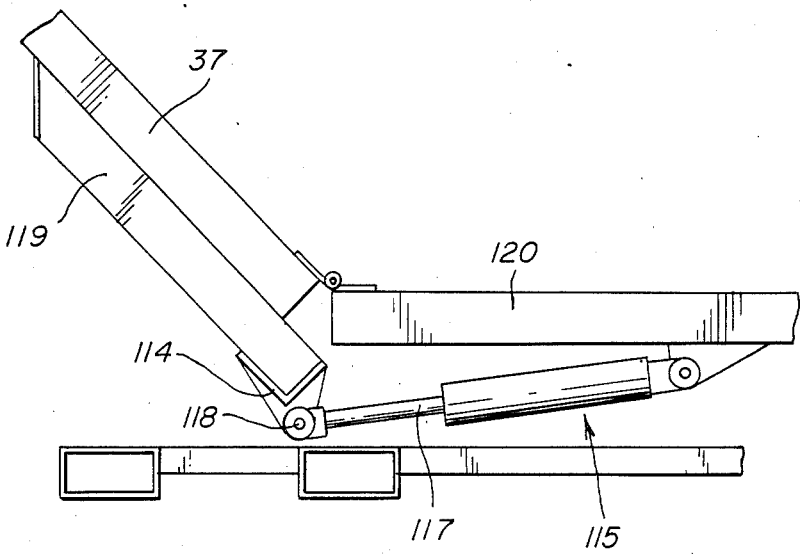
FIG. 31 shows the mechanism of FIG. 30 after the floor has been rotated toward the vertical position by about 45 degrees.

A mechanism for rotating the floor 37 into position is shown in side view in FIGS. 30 and 31. When the expanded section is actuated, the floor member 37 is rotated from its stacked, vertical position to a horizontal position where it serves as the floor of the expanded section. The double acting hydraulic cylinder 115, and its counterparts along the length of the floor member 37, serve as both driving and holding means. Hydraulic cylinders 115 are attached by a pivot mount 116 underneath the floor 120 of the core structure 10. The cylinder rod 117 of hydraulic cylinder 115 is attached by pivot mount 118 to a right angle scoop 114 attached to floor extension 119. Extension 119 serves to extend the depth and travel of the floor 37 so that with a slight rotation of the axis of hydraulic cylinder 115 about pivot mount 116 movement of the floor 37 through 90 degrees about continuous hinge 38 may be accomplished. In the horizontal, deployed position the hinge 38 and the action of hydraulic cylinder 115 serve to hold the floor 37 steady. In addition, the floor 37 rests on the lower power beams 33A, 33B, 33C and 33D, shown particularly in FIG. 4.

The connections between the structural members of the expanded section may be seen for one embodiment by comparing FIGS. 7A and 9. The selected sidewall/roof 14 against which the structural members of the expanded section are stacked is connected by continuous hinge 19 to the sidewall 13; the selected sidewall/roof 14 is seen to form a principal part of the sidewall 13. Next in order is the sidewall 26 which is positively held on its bottom by lower power beams 33A, 33B, 33C and 33D which are housed within the floor 120 of the core section. Next in order, the endwalls 27A and 27B are interconnected about hinge 29 inbetween sidewall 26 and floor 37. At the outer edge of endwall sections 27A there is a connection to sidewall 26 by continuous hinge 28; at the inner edge of endwall section 27B there is a connection to sidewall 13 by continuous hinge 30. Finally, the floor section 37 is connected with the floor of the core section by means of continuous hinge 38. In the unexpanded mode each of the aforedescribed structural members is stored in vertical side by side relationship and against the selected sidewall/roof 14. The connections between the structural members in another embodiment may be seen by comparing FIGS. 13A an 16. Here, the selected sidewall/roof 14 is connected to the frame by hinge 19. The sidewall 26 is positively held by the linear power beams within the subflooring as shown particularly in FIG. 11. The unitary endwalls 32 are connected by continuous hinge 46 with the sidewall 13. Finally, the floor 37 is connected by hinge 38 with the floor 120 of the core structure.

A manually actuated, small scale version of the expandable structure of the present invention is shown in FIGS. 32-37. Here, a travel trailer 130 incorporates an expandable structure 128 on one side. As seen in the cross sectional plan view of FIG. 36, the structural members in their stored position occupy only a small portion of the interior space of the travel trailer adjacent the selected sidewall/roof 131. The structural members comprise, in order of stacking, the selected sidewall/roof 131, sidewall 133, folded endwall sections 132*a* and 132*b*, and floor 135. Selected sidewall/roof 131 is connected by hinge 136 to the side 129; endwall sections 132*b* are connected by hinges 137 to the side 129; and floor 135 is connected by hinge 140 to the side 129. In addition, the foldable endwall sections 132*a* and 132*b* are interconnected by continuous hinge 139; and the endwall sections 132*a* are connected to sidewall 133 by hinges 138. The structural members, and particularly the floor 135 and the endwall sections 132*b* are of durable sheet material in order to support furniture, goods and personnel within the expanded section with no support of the expanded section from the ground.

Sequence of Expansion

The special function of the expandable core structure 10 is that it may be rapidly expanded into a substantial structure which has a multiple of the original floor space avilable for useful operations. The sequence of expansion is a key to the successful accomplishment of this function. The sequence of expansion is illustrated in FIGS. 1–6. The expansion sequence is straightforward and may be carried out in a matter of minutes by personnel having minimal skills. The sequence contemplates first deploying a significant portion of the initial sidewall 13, the selected sidewall/roof 14, as one of the structural members of the expanded section and then deploying, in the logical order described subsequently, the remaining structural members. The structural members are individually actuated rather than being actuated as groups of structure as, for example, in J. A. Wenger, "Mobile Center," U.S. Pat. No. 3,602,564, or A. J. Reynolds, et al., "Expandable Portable Shelter," U.S. Pat. No. 3,421,268.

Deployment of the individual structural members may be by hand for small, lightweight versions or by mechanical means for commercial or industrial units. In the preferred commercial embodiment, the motive means are linear power beams enclosed within the roof structure and within the subflooring thereby leaving the interior of the core volume free of expansion hardware. The motive means for the power beams may be hydraulic, mechanical or electrical. The motive means, in order of preference, are as follows:

(1) Hydraulic.
(2) Hydraulic over mechanical.
(3) Electrical over mechanical.
(4) Manual.

In the ensuing discussion, it should be realized that the deployment of an expanded structure on one side of the structure 10 is being described. A key feature of the present invention is that a companion structure may be expanded on the opposite side of the core structure or on either end. Each expansion is able to provide a side room of comparable floor space to the initial core structure 10. As described subsequently, this is due to the ability of the upper and lower power beams to translate linear movement into rotational and extended linear forces without occupying any portion of the interior volume of the core structure.

The first step in the sequence of expansion is to rotate the selected sidewall/roof 14 up to form the roof of the expanded section. Initially, as shown in FIGS. 1–3, the selected sidewall/roof 14 forms a majority of the sidewall 13 and is hinged to the roof perimeter frame 16 by continuous hinge 19. As a preliminary step, the locks 9 are released so that the bottom of the selected sidewall/roof 14 is free to rotate away from floor perimeter frame 17. Along its length, at regular intervals, the selected sidewall/roof 14 is attached by cables 22A, 22B, 22C, and 22D to the upper power beam units 21A, 21B 21C, and 21D, respectively. The function of the upper power beams 21A, 21B, 21C, and 21D is to apply a torque to the selected sidewall/roof 14 about the continuous hinge 19 to produce a rotation of the selected sidewall/roof 14 from the vertical to the horizontal position. A detailed description of these upper power beams is provided in the co-pending patent application of Bruce A. Jurgensen, entitled "Power Beam for Rotating Structural Member," Ser. No. 739,555, filed on May 30, 1985. Briefly, and as described previously in the section "Expandable Structure," the power beam units comprise apparatus of linear configuration which are housed, respectively, within the power beam enclosures 20A, 20B, 20C, and 20D located inbetween the roof sections 11 of the core structure 10. Within each power beam enclosure, in the preferred embodiment of the expandable structure, there will be a companion power beam unit oriented in the reverse direction for rotating the companion selected sidewall/roof on the opposite side. In operation, the slideable beams 24A, 24B, 24C, and 24D are driven outward from the surface of roof perimeter frame 16 by means of hydraulic cylinder 52, shown in FIGS. 18–20. The slideable beams 24A, 24B, 24C, and 24D are first driven to the point where a sufficient force is first applied to lift the selected sidewall/roof 14; this point at which lift is initiated is shown in FIG. 2. Initiation of lift occurs when the cable 58, 22 stretches the spring 64 to the point that fitting 63 contacts stop 62. When this point is reached, the hydraulic cylinder 52 continues to drive the cylinder rod 51 outward, and the slideable beams 24 continue to move outwardly thereby drawing the cables 22A, 22B, 22C and 22D up into the interior of the slideable beams 24A, 24B, 24C and 24D, so that a significant torque is applied to selected sidewall/roof 14 about the continuous hinge 19. Rotation continues gradually until the cylinder rod 51 reaches the end of its travel at which point the selected sidewall/roof 14 will be substantially in a horizontal position and positioned so that the sidewall 26 and endwalls 27*a* and 27*b* may be moved under it. As seen by comparing FIGS. 4 and 5, the slideable beams 24A, 24B, 24C and 24D may be withdrawn once the selected sidewall/roof 14 is supported by endwalls 27A and 27B and by sidewall 26, and the spring 64 will take up the slack on the cable 58.

Figure 5:
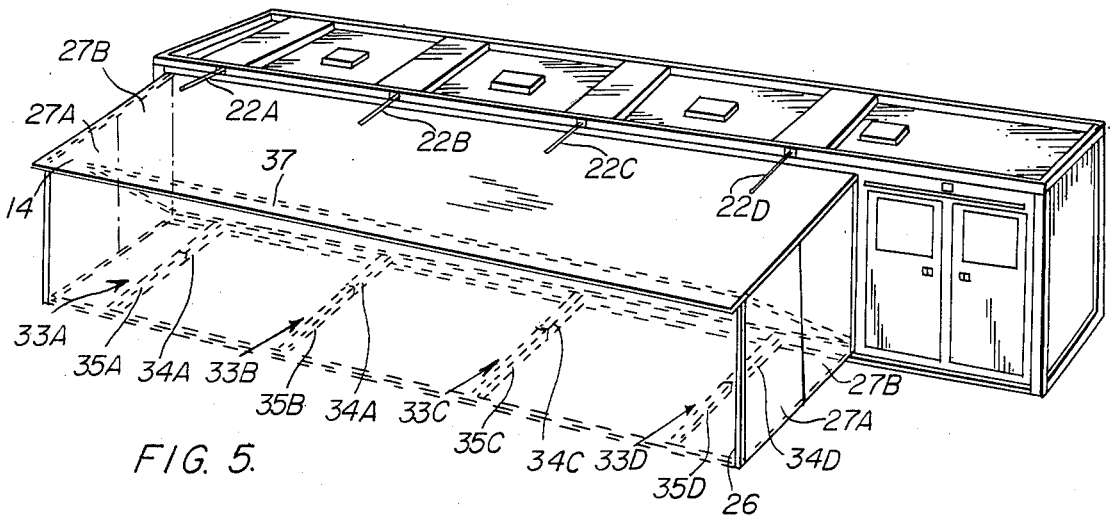
FIG. 5 is a view of the expandable structure after the sidewall of the expanded section has been driven by the lower power beams to its fully deployed position, the endwalls have locked into position, and after the floor has been rotated from the vertical, stacked position to an intermediate position.
Figure 6:
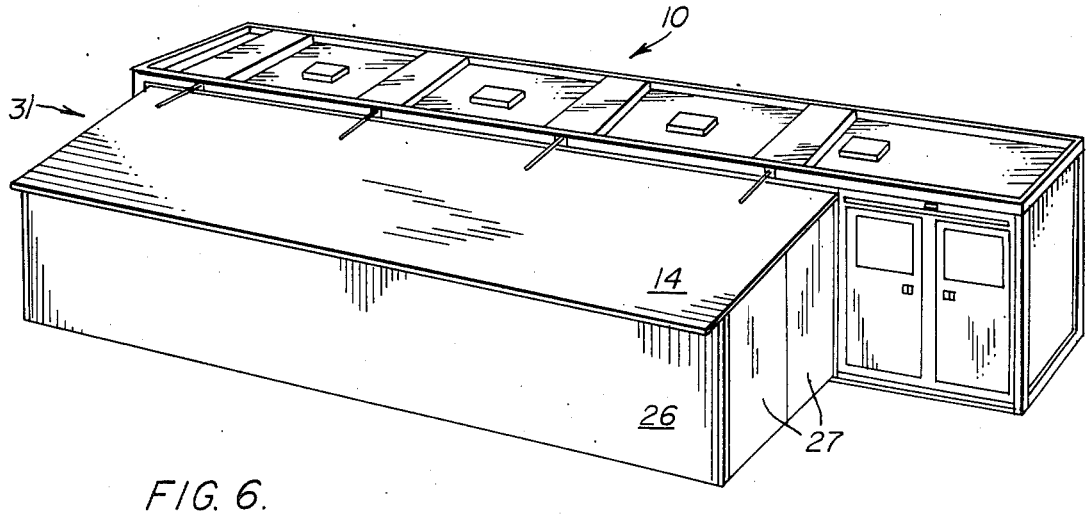
FIG. 6 is a view of the expandable structure after the expanded section has been fully deployed.

The next step in sequence in the preferred embodiment is to force the sidewall 26 outwardly. This is accomplished by means of lower power beams 33A, 33B, 33C, and 33D, which positively hold sidewall 26 as shown in FIGS. 4–5 and 11. These power beams are housed within the subflooring of the core structure 10 and may consist of apparatus as shown in FIGS. 21–23A, FIGS. 24–26A or 27–29A. The power beams 33A, 33B, 33C, and 33D are actuated in unison so that each section of the wall experiences comparable force and stresses are not imparted to the wall 26. By the time the sidewall 26 is fully deployed by means of the lower power beams 33A, 33B, 33C, and 33D, the endwalls 27A and 27B are also fully deployed as they have been pulled along behind the sidewall 26. When fully deployed, they are held taut between the edges of sidewall 26 and sidewall 13 and vertical corner member 15*a*.

For the embodiment of FIGS. 11–17 having solid endwalls 32, a separate step is followed at this junction to rotate the endwalls 32 into position. The hydraulic cylinders 47 are actuated to rotate the endwalls 32 about the hinge 46 which connects the endwalls 32 to the sidewall 13. The stored position is shown in plan view in FIG. 15A. The deployed position is shown in side view in FIG. 14 and in plan view in FIG. 15B. In FIG. 11 the endwall 32 is shown in perspective view as it is being rotated into position.

The final step in the sequence of expansion is the lowering of the floor 37 about the continuous hinge 38, as shown in FIG. 5. Here, the floor 37 is being rotated about hinge 38. The manner of rotation may be seen by comparing FIG. 30 with FIG. 31. In FIG. 31, the double acting cylinder 115 has been actuated to rotate the floor 37 from its vertical, stored position through 45 degrees. Once the floor has been fully rotated into place, as shown in FIG. 30, the expanded section is now complete as shown especially in FIGS. 6 and 12.

A reversal of the above-described sequence is followed to collapse the expanded section. Thus, the floor 37 is first rotated to an upright position; the slideable beams of the upper power beam are extended to again support the selected sidewall/roof 14; power beams 33A, 33B, 33C, and 33D retract the sidewall 26, thereby causing endwalls 27A and 27B to fold together inwardly about continuous hinge 29; an the upper power beam is gradually retracted to allow the selected sidewall/roof 14 to rotate downwardly into its vertical position as a substantial portion of sidewall 13. In practice, it has been found that deploying and collapsing the expandable structure of the type of FIGS. 1–6 and FIGS. 11–12 takes only a few minutes.

The sequence of expansion for manually actuated units of the type of FIGS. 32 to 37 is the same as previously described for units actuated by power beams. Here, the forces are applied by one or more individuals who rotate, push or pull the structural members into place. A pole may be provided to push initial sidewall 131 into position; handles may be provided on sidewall 133 to allow it to be pulled out from the outside; and a cord may be provided on the inside of the travel trailer 130 to allow the floor 135 to be slowly rotated into position. The sequence of expansion for the expandable structure 128 is as follows:

(1) rotate the selected sidewall/roof 131 upwardly from its vertical position to a near horizontal position;

(2) pull sidewall 133 outwardly to both support selected sidewall/roof 131 and to form an exterior boundary for the expanded structure;

(3) pull endwall sections **132*a* and 132*b* from their folded position to an extended, locked position, as an inherent part of performing step (2) for this embodiment. If the endwalls are solid units such as shown for the embodiment of FIG. 11 then a separate step is performed; and (4) lower floor 135** from the vertical, stacked position to the deployed horizontal position.

Figure 36:
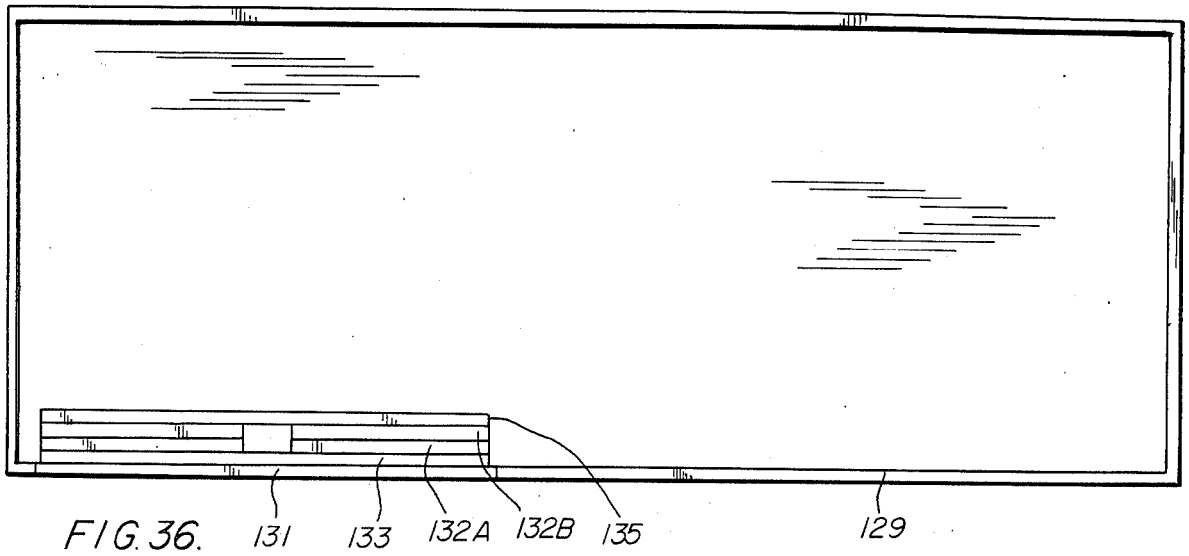
FIG. 36 is a plan cross sectional view taken through lines 36—36 in FIG. 32.
Figure 37:
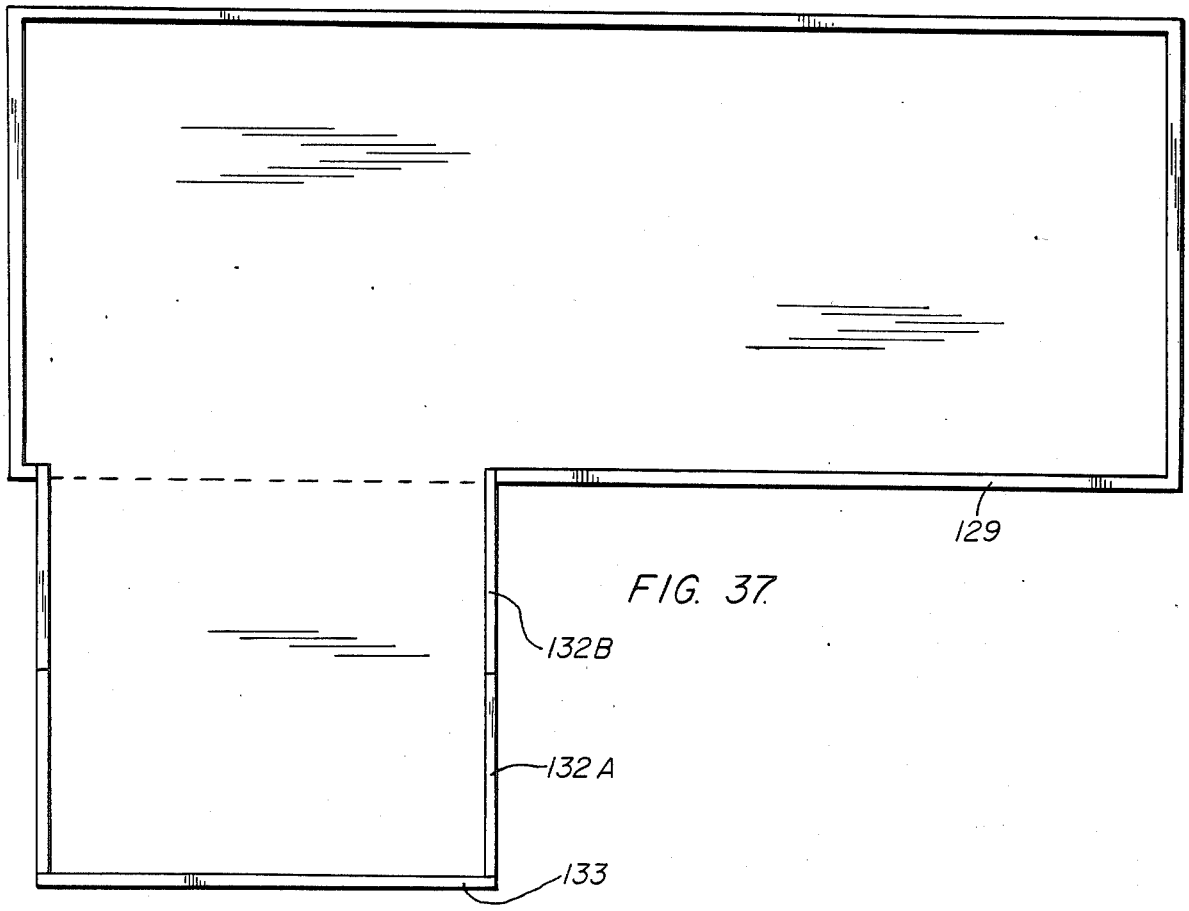
FIG. 37 is a plan cross sectional view of FIG. 32 taken at the height of FIG. 36 after the expanded section has been fully deployed.

The sequence for collapsing the expanded structure of FIGS. 32–35 is as follows:

(1) rotate floor 135 about continuous hinge 140 from the deployed horizontal position to the vertical, stacked position shown in FIG. 36;

(2) push sidewall 133 inwardly, thereby folding the endwall sections **132*a* and 132*b* together about continuous hinge 139 ahead of sidewall 133; and (3) lower selected sidewall/roof 131 so it serves as a substantial part of the side 129**.

Figure 10:
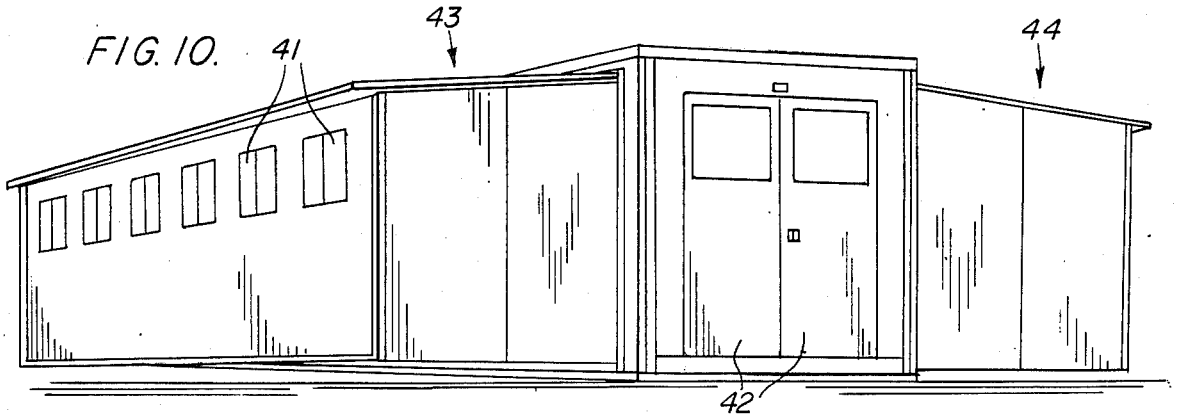
FIG. 10 is an end perspective view of an alternate embodiment of an expandable structure in accordance with the present invention which has windows in the sidewalls of the expanded section and doors at the end of the core structure.

The principle of the expandable structure and sequence of expansion of the present invention can be applied in numerous configurations. For example, as shown in FIG. 10, the expanded section can extend the full length of the enclosed structure and can have a row of windows 41 along the side. Here, the doors 42 are shown to be located on the end of the enclosed structure. Also, the expanded section 43 runs the full length of the opposite side of the enclosed structure, and the power beams for actuating the expanded sections reside side by side in reverse orientation in power beam enclosures such as enclosures **20*a*–20*d* of FIG. 3** and within the subflooring of the core structure. In addition, by arranging the power beam units at different levels, a core section may have expanded sections on all sides. The minimal storage volume on each side that is occupied by the structural members does not reduce significantly the storage space available within the core structure, even for such embodiments.

Figure 7:
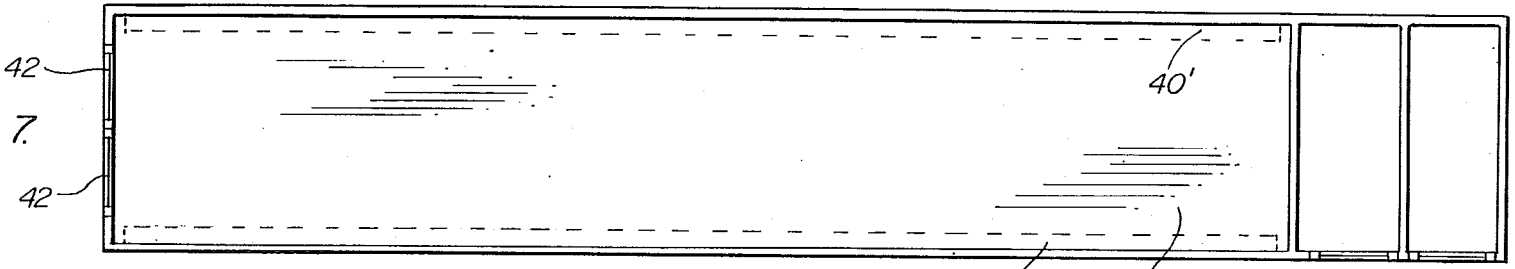
FIG. 7 is a cross sectional top view of the expandable structure taken through lines 7—7 of FIG. 1 which shows the minimal amount of floor space occupied by the structural members as they are stacked adjacent the selected sidewall/roof.
Figure 7A:
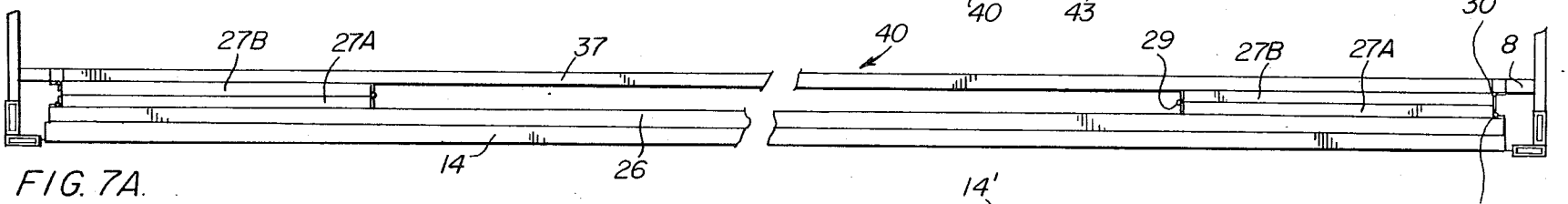
FIG. 7A is an enlarged view of one of the sets of structural members, showing especially the order of stacking for this embodiment.
Figure 8:
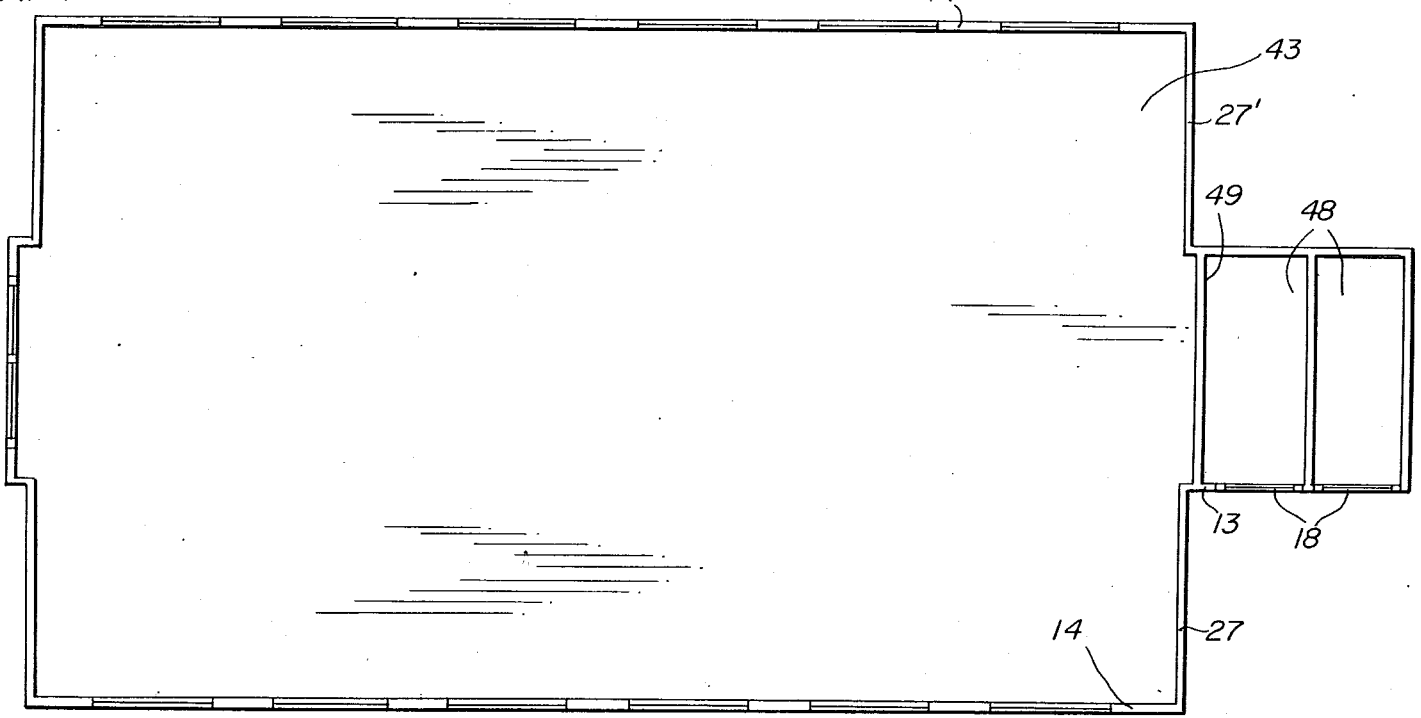
FIG. 8 is a cross sectional top view of a core section and two fully deployed contiguous expanded sections taken at the same height as the view of FIG. 7.

The utility of the expandable structure of the present invention is highlighted by the cross sectional views of FIGS. 7, 7A and 8, and FIGS. 13 and 13A. In FIGS. 7 and 13, it may be seen that the areas 40 and 40' are the only portions of the total floor space of the core structure which are dedicated to storing the structural members of the expanded sections. The majority of the floor space 43 in the interior is available for storage of equipment and supplies. In addition, as shown particularly in the plan view of FIG. 8, when the sections on opposing sides of the core structure are fully expanded, no expansion hardware remains within the composite structure, either in the region of the core structure or in the regions of the expanded structures. The entire floor space is available for the application for which the structure is being used. Controls for the power beams, hydraulic pumps and reservoirs, diesel generators and other equipment are housed in rooms 48 which are externally accessible through doors 18 but separated by wall 49 from the interior floor space 43. This is particularly desirable for applications which require a clean, high quality environment such as field hospitals. Here, the quality of the interior environment is determined by the wall and ceiling coverings which are adhered to the interior surfaces of the core structure and the expanded sections and to the air conditioning equipment used.

Figure 38:
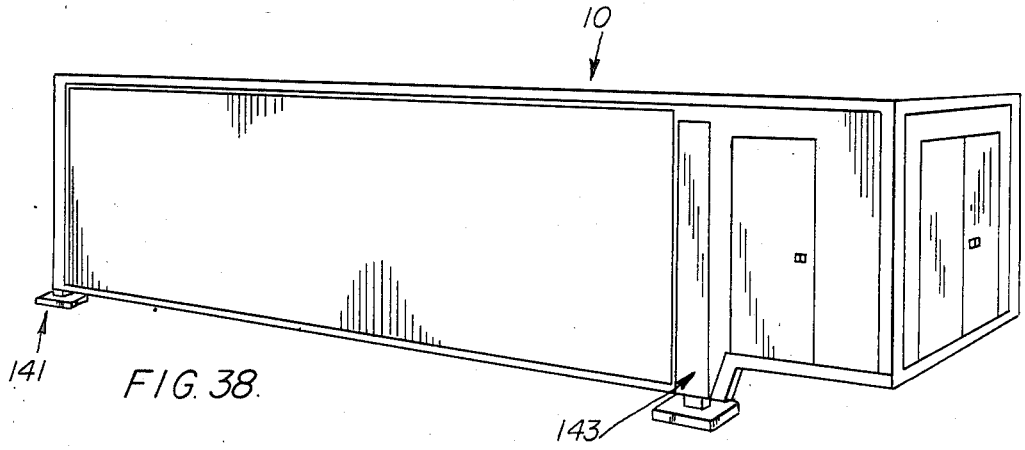
FIG. 38 is a perspective view of an expandable structure resting at ground level on means for raising the structure.
Figure 39:
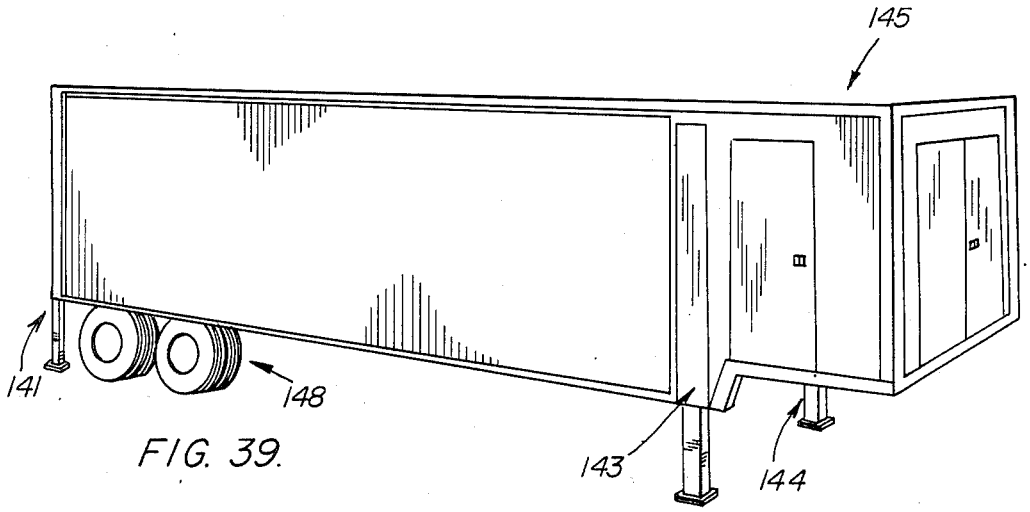
FIG. 39 is a perspective view of FIG. 38 after the structure has been raised above ground level by the means for raising the structure and after a set of wheels has been attached.
Figure 40:
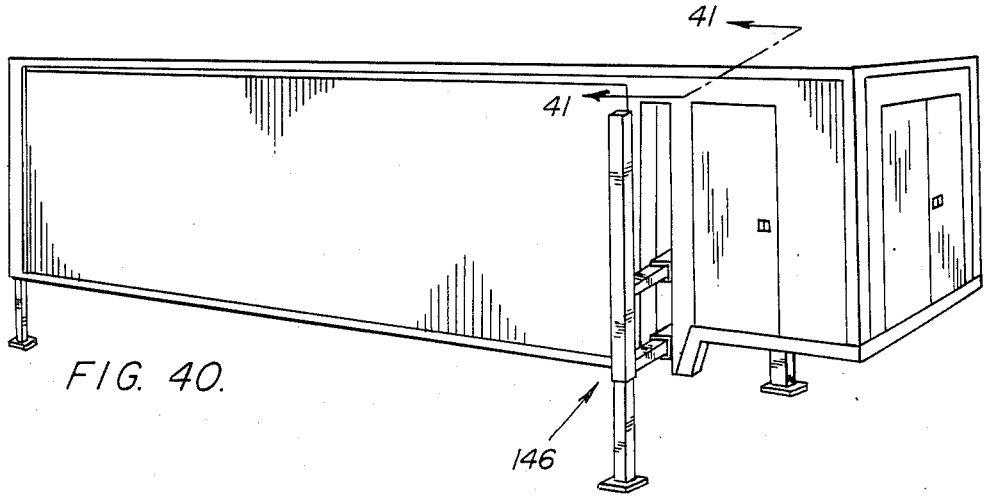
FIG. 40 is a perspective view of FIG. 38 after the forward means for raising the expandable structure has been deployed away from the core structure and after the structure has been raised above ground level.
Figure 41:
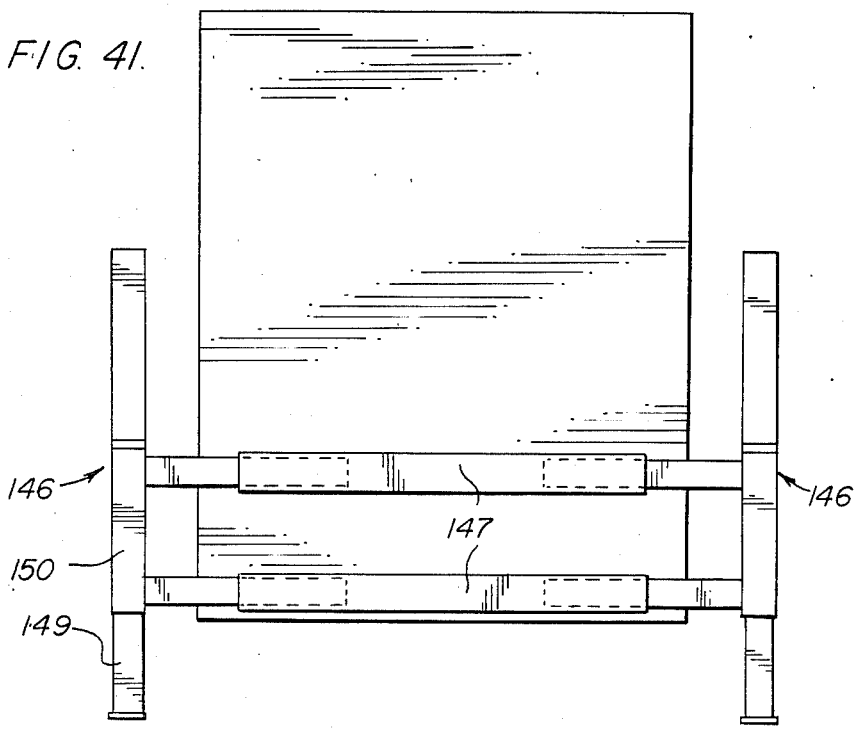
FIG. 41 is a cross sectional view taken through lines 41—41 in FIG. 40.
Figure 42:
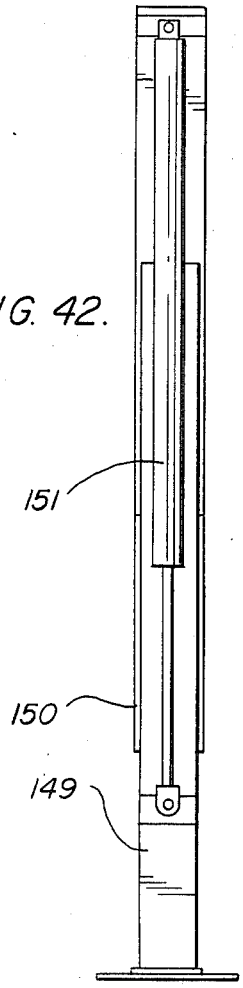
FIG. 42 is a side view of a vertical jack assembly from FIGS. 38–40.
Figure 43:
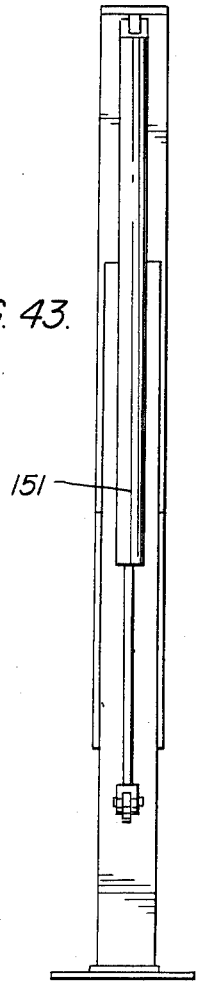
FIG. 43 is a view of FIG. 42 rotated 90 degrees.

To facilitate setting up the expandable structure in the field there may be provided means for raising the core structure above ground level and lowering it to the ground. Thus, as shown in FIGS. 38–40, the core structure 10 incorporates a set of vertical jacks 141 and 142 within the vertical corner members 15A and 15D, respectively (vertical jack 142, not shown here but incorporated in vertical corner member 15D as shown in FIG. 1). When actuated, the vertical jacks 141 and 142 will raise the rear end of the core structure up above ground level, as shown especially in FIGS. 39 and 40. A complementary set of vertical jack assemblies 143 and 144 are incorporated within the framing of the equipment room 145. The vertical jack assemblies 143 and 144, shown especially in the cross sectional view of FIG. 41, comprise a vertical jack unit 146 and horizontal displacement members 147. In operation, if the core structure is to be placed on wheels and towed by a highway tractor, the vertical jacks 141 and 142 are actuated to elevate the rear of the core structure and the vertical jack units 146 of the vertical jack assemblies 143 and 144 are actuated in place. A set of wheels 148 (Bogies) are fitted on the rear of the core structure 10, a tractor (not shown) is connected to the forward end of the core structure and the expandable structure is transported to the desired location. If the core structure is to be placed on an equipment hauling trailer, the horizontal displacement members 147 are first actuated to drive the vertical jack units 146 outwardly whereupon the vertical jack units 146 are actuated at the same time as the vertical jacks 141 and 142. Then the trailer is backed up under the core structure 10 and the core structure is lowered onto the trailer. The trailer is able to move underneath the core structure 10 because the vertical jack assemblies 143 and 144 have been displaced laterally and allow the trailer to pass between them. The horizontal displacement members 147 are actuated by direct linkage hydraulic cylinders (not shown). The vertical jack units 146 consist of a hydraulic cylinder 151 which drives the inner member 149 in telescoping relationship with the stationary member 150, as shown in FIGS. 42–43. The expandable structure may thus be taken from one location to another and set up at will.

I claim:

1. An expandable structure, comprising:

a core structure having a roof section, sidewall sections, endwall sections and a floor section;

a plurality of structural members hinged to a frame of said core structure and vertically stacked adjacent a selected one of said sidewall sections, a substantial portion of said selected sidewall section being hinged to said frame of said core structure, said selected sidewall section being rotatable outwardly to form the roof of a contiguous expanded structure, said structural members being capable of deployment subsequent to said deployment of said selected sidewall, to form a window wall, end walls and the floor of said contiguous expanded structure;

power beam means housed within said roof section of said core structure to drive said selected sidewall-/roof outwardly to form said roof of said contiguous expanded structure; and power beam means housed within said floor section of said core structure to deploy said window wall, end walls and said floor of said contiguous expanded section.

2. An expandable structure in accordance with claim 1 wherein said plurality of structural members comprise, in order of stacking from said selected sidewall, a window wall, endwalls and the floor of said contiguous expanded structure.

3. An expandable structure in accordance with claim 1 wherein said upper power beam comprises:

a slideable beam housed in said roof section of said core structure adjacent said selected sidewall;

means for driving said slideable beam in a linear direction;

cable means attached at one end to said selected sidewall, said cable means contacting an end of said slideable beam;

a spring attached between the frame of said core structure and the other end of said cable means so that as said beam is driven in a linear direction, force is imparted along said cable to said selected sidewall and to said spring; and a stop member positioned adjacent said cable means and a set distance apart from the end of said spring attached to said cable when said spring is in its unstretched position whereby as said slideable beam is driven outwardly, said cable draws said spring from its unstretched position to a position at which said spring contacts said stop member, and thereafter an appreciable torque is applied by said cable to said selected sidewall.

4. An expandable structure in accordance with claim 3 wherein said means for driving said slideable beam comprises a double acting hydraulic cylinder.

5. An expandable structure in accordance with claim 3 wherein said means for driving said slideable beam comprises a threaded shaft which journals through a threaded nut attached to said slideable beam.

6. An expandable structure in accordance with claim 1 wherein said lower power beam for deploying said sidewall comprises:

a stationary receiving member;

an intermediate telescoping member which is slideable within said stationary receiving member;

a forward telescoping member which is slideable within said intermediate telescoping member;

motive means linked to said intermediate telescoping member to impart linear movement to said intermediate telescoping member;

an outward cable attached to said stationary receiving member and extending around the forward end of said intermediate telescoping member into said intermediate telescoping member, and thence over the rear end of said forward telescoping member and along said forward telescoping member to a connection to said structural member so that as said motive means applies an outward force to said intermediate telescoping member, said cable drives said forward telescoping section outwardly; and an inward cable attached to said stationary receiving member and extending around a pulley fastened to said stationary receiving member and thence to an attachment to said structural member whereby as said motive means applies an inward force to said intermediate telescoping member, said inwardly cable draws said structural member inwards and draws said forward telescoping member into said intermediate telescoping member.

7. An expandable structure in accordance with claim 6 wherein said motive means comprises a double acting hydraulic cylinder.

8. An expandable structure in accordance with claim 6 wherein said motive means comprises a rack and pinion assembly wherein the rack of said assembly is attached to said intermediate telescoping member and pinion of said assembly is driven by external means.

9. An expandable structure in accordance with claim 1, in combination with:

means to raise said core structure above ground level and to lower said core structure from an elevated position to ground level.

10. An expandable structure in accordance with claim 9 wherein said means to raise said core structure includes a pair of vertical jacks housed within at least two corners of said frame of said core structures and a pair of jack assemblies housed within said frame adjacent an edge of said selected sidewall.

11. An expandable structure in accordance with claim 10 wherein said jack assemblies each comprise:

vertical jack means; and horizontal jack means housed within said frame, said horizontal jack means being attached to said vertical jack means so that said vertical jack means may be displaced outwardly from said core structure before actuation to permit a trailer to be backed up under said core structure in its elevated position.

12. An expandable structure in accorance with claim 11 wherein said vertical and said horizontal jack include hydraulic cylinders.

13. An expandable structure in accordance with claim 11 wherein said vertical and horizontal jacks include screw drive mechanisms.

14. A sequence of expansion for expanding a core structure core structure and a contiguous, structure having a frame, a roof section, sidewall sections, endwall sections and a floor section, comprising the steps of:

rotating a selected sidewall of said core section, said sidewall being the sidewall of said core section adjacent which said core structure is to be expanded, said selected sidewall being rotated from its vertical position as a sidewall of said core structure to a horizontal position as the roof of said expansion of said core structure, said rotation occuring about a hinged connection with the frame of said core structure, said rotation being accomplished by applying a power beam housed within said roof section of said core structure; and deploying the window wall, endwalls and floor of said contiguous expanded section from vertical stacked positions adjacent said selected sidewall by power beam means housed within the subflooring of said floor section of said core section.

15. A sequence of expansion in accordance with claim 14 wherein said step of rotating a selected sidewall is accomplished by the step of sliding a beam in a linear direction adjacent said selected sidewall, whereby said sliding beam imparts a force to a cable attached to said sidewall and thence a force is imparted to said selected sidewall to cause said selected sidewall to rotate about said hinged connection with the frame of said core structure.

* * * * *